US005746503A

United States Patent [19]

Hillstrom et al.

[11] Patent Number: 5,746,503

[45] Date of Patent: May 5, 1998

[54] ILLUMINATED CANOPY SYSTEM

[75] Inventors: David U. Hillstrom, Novi; Brian J. Hillstrom, Milford, both of Mich.

[73] Assignee: Marketing Displays Inc., Farmington Hills, Mich.

[21] Appl. No.: 321,045

[22] Filed: Oct. 5, 1994

Related U.S. Application Data

[63] Continuation-in-part of Ser. No. 996,103, Dec. 23, 1992, Pat. No. 5,381,324.

[51] Int. Cl.[6] ..... F21V 1/12

[52] U.S. Cl. ..... 362/248; 362/240; 362/355; 362/362; 362/375; 362/812

[58] Field of Search ..... 362/145, 147, 362/151, 152, 223, 225, 240, 242–244, 246, 248, 249, 330, 343, 355–357, 361, 362, 367, 375, 374, 812; 40/564, 577, 603, 604

[56] References Cited

U.S. PATENT DOCUMENTS

| | | | |
|---|---|---|---|
| 1,686,615 | 10/1928 | Balnojan | 40/433 |
| 2,058,058 | 10/1936 | Caccia | 40/577 |
| 2,141,139 | 12/1938 | Howe et al. | 40/563 |
| 2,559,991 | 7/1951 | Owen | 40/545 |
| 2,588,545 | 3/1952 | Lawrence | 40/152.2 |
| 3,064,121 | 11/1962 | Greene | 362/225 |
| 3,296,431 | 1/1967 | Green | 40/570 |
| 3,419,986 | 1/1969 | Maze | 40/564 |
| 4,240,220 | 12/1980 | Smith | 40/564 |
| 4,267,489 | 5/1981 | Morohashi | 315/324 |
| 4,430,819 | 2/1984 | Chandler | 40/564 |
| 4,452,000 | 6/1984 | Gandy | 40/574 |
| 4,512,098 | 4/1985 | Ready et al. | 40/610 |
| 4,802,296 | 2/1989 | Kovalak, Jr. | 40/607 |
| 4,817,317 | 4/1989 | Kovalak, Jr. | 40/549 |
| 5,006,966 | 4/1991 | Mikalonis | 362/74 |
| 5,020,252 | 6/1991 | De Boef | 40/564 |
| 5,044,102 | 9/1991 | Finch et al. | 40/603 |
| 5,188,453 | 2/1993 | Subisak et al. | 362/329 |

FOREIGN PATENT DOCUMENTS 721217 3/1932 France .

OTHER PUBLICATIONS

Citgo Specification and Assembly Instructions for "Hi–Rise Signs/Poles" (Rev. Jan. 1993).
Young Electric Sign Co. Drawing 88–1451–1 (Apr. 1989).
Young Electric Sign Co. Drawing 88–1451–2 (Apr. 1989).
Young Electric Sign Co. Drawing 88–1451–3 (Apr. 1989).
Young Electric Sign Co. Drawing 88–1451–4 (Apr. 1989).
Young Electric Sign Co. Drawing 88–1451–5 (Apr. 1989).
Bethel Corporation Drawing 90299D (Dec. 1990; Revised Jan. 1991).
Untitled (but probably Bethel Corp.) 90299C (Dec. 1990; Revised Jan. 1991).
4 Drawings by Vacufoam Industry for "Wendy's" signs (Drawing Nos. 840178 and 840178R (Nov. 1990).
Young Electric Sign Co. Drawing 88–1451–1 (Nov. 1988).
Zimmerman Sign Co. Drawing FLJ–0–000 (Oct. 1990).
Holiday Inns, Inc. Drawing M–10(?) (Nov. 1982).

*Primary Examiner*—Alan Cariaso
*Attorney, Agent, or Firm*—Brooks & Kushman

[57] ABSTRACT

A rear illuminated light box device for mounting on a surface is disclosed. The device has a support structure comprising support brackets, top and bottom edge frame members, and corner members which hold in place a front translucent sheet material or panel member. The front member can be flexible and stretched in place, or rigid panels. Metal halide lights are used to illuminate the front member. A flat or curved light dispersion member is positioned between the lights and the translucent material to uniformly distribute and disperse the light on the front member. Access members in the apparatus allow convenient changes of the lights.

55 Claims, 13 Drawing Sheets

ILLUMINATED CANOPY SYSTEM

CROSS REFERENCE TO RELATED APPLICATIONS

This is a continuation-in-part of U.S. patent application Ser. No. 07/996,103, filed on Dec. 23, 1992, now U.S. Pat. No. 5,381,324, issued on Jan. 10, 1995.

TECHNICAL FIELD

The present invention relates to lighted canopy and wall systems, particularly for gasoline service stations and other business establishments. The fascias of the canopies have transparent displays which are illuminated from the rear for visibility and aesthetics. Similarly, back-lit light boxes are mounted on the buildings.

BACKGROUND OF THE INVENTION

Businesses with outdoor service areas, such as gasoline service stations, are taking steps today to improve the facilities and areas around them. The companies want to keep their places of business attractive for customers, keep the appearances on par with other businesses, and also make the facilities better illuminated and safer in non-daylight hours.

Service stations in particular today are improving the areas around their buildings and gasoline pumps by providing increased lighting and more aesthetic and efficient structures. In particular, illuminated and aesthetic protective canopies are being installed over the gasoline pumps. Many of these canopies have signs, lights, or lighted faces along their fascias. In addition, wall mounted signs are also being installed on the buildings or surrounding structures. Many of these signs are also lighted for increased visibility.

Where the canopy fascias and wall signs are illuminated, one of the difficulties has been to create a uniform light distribution on the outer (visible) surfaces. Typically, fluorescent lights (internally) or floodlights (externally) are used and these types of illumination provide uneven or nonuniform light distribution. Also, the fluorescent lights which are often 6, 8 or 10 feet in length are difficult to change when they burn out. Changing burned out lights in conventional illuminated canopy and fascia systems is an expensive and time-consuming task, often requiring a boom truck or extension ladder. Moreover, it is often necessary to dismantle a portion of the canopy or fascia apparatus in order to change the lights.

Another difficulty with known canopy fascia systems as well as wall-mounted signs, concerns the quality and integrity of the sign panels. Weather conditions and changes in temperature sometimes create ripples and waves in the sign panels reducing their effectiveness and attractiveness. The durability of some types of sign panels has not been sufficient.

Another problem with known illuminated canopy and fascia systems, as well as wall-mounted signs, concerns the corner intersections between adjacent surfaces. Some systems have had difficulty creating a uniform light pattern at these corners. Creating a smooth wrinkle-free surface at the corners and a clean edge is also a problem with some systems.

It is an object of the present invention to provide illuminated canopy and wall-mounted systems, particularly for service stations, which are improvements over known systems. It is another object of the present invention to provide illuminated canopy and wall-mounted systems which distribute the light uniformly on and through the display faces of the systems.

It is also an object of the invention to provide illuminated canopy and wall-mounted systems in which the light sources are easy to change and maintain. It is still another object of the invention to provide illuminated canopy and wall-mounted systems which are more energy efficient than known systems today, have improved lighting and have reduced cost for use and maintenance. An additional object of the invention is to provide illuminated canopy and wall-mounted systems which have improved illumination and aesthetics at the corners of adjacent panels.

These and other objects, features and advantages of the invention will become apparent from the following description of the invention and appended claims, when viewed in accordance with the attached drawings.

SUMMARY OF THE INVENTION

The present invention provides improved illuminated canopy and wall-mounted systems for business establishments, such as service stations. The systems can be installed over existing fascias on the canopy and/or on wall surfaces of the building. A "light box" is provided having supporting brackets connected to a rear panel member or wall surface. A decorated translucent sheet or panel member is placed across the face of each of the light boxes and held in place by extrusions or similar members. The panel member is preferably flexible and is stretched across the face. A plurality of lights (preferably metal halide lights) are provided in the light boxes. A light dispersion panel is placed over the light sources in order to distribute the light uniformly on the face of the sign panel. Trim caps are provided on the top and bottom of the lighting apparatus to form an enclosed structure and make it weatherproof where necessary.

The light dispersion panel preferably is a sheet or film of material having a pre-specified pattern of light openings which allows the light to be evenly distributed on the front translucent sheet or panel. The light dispersion panel can be curved, flat or any other shape depending on the configuration of the light box structure and/or the desired distribution of light.

Access doors or removable panels are provided in the structures adjacent the lights. The access members allow replacement of the lights either manually or with a conventional tool. Preferably the access doors or panels are in the bottom or lower surfaces of the systems in order to facilitate removal and replacement from the ground. The access doors preferably are hinged and spring biased for ease of usage. Also, openings can be provided in the light dispersion panel where necessary, or the film can be selectively detachable, if required to replace the lights.

If required to support the dispersion panel and keep its required shape and position, a clear plastic member can be provided under the dispersion film. The support also can have one or more openings in it to allow changing of the lights where necessary. Fasteners such as self-drilling screws or nuts and bolts are used to attach various parts together which allow a less expensive and faster method for assembly.

An improved corner assembly for the light box structures is also provided. Spring metal tensioning members are used to hold the flexible front film in place under tension, and yet do not block the light from reaching the corners.

BRIEF DESCRIPTION OF THE DRAWINGS

is

BEST MODE(S) FOR CARRYING OUT THE INVENTION

Figure 1:
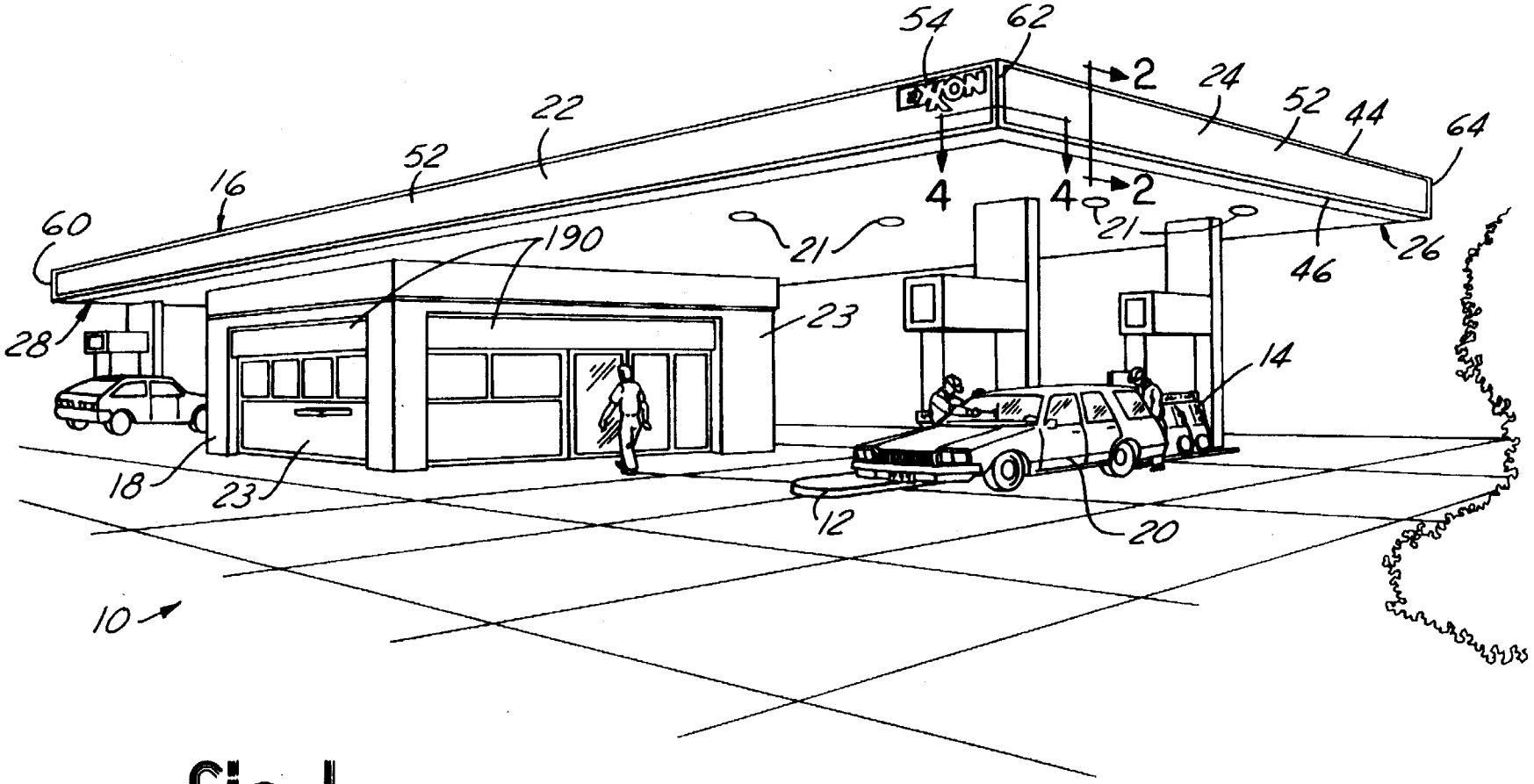
FIG. 1 illustrates the present inventive illuminated canopy and fascia system in use at a service station.

FIGS. 1–5 illustrate the features and advantages of the present inventive illuminated canopy and fascia system, The present invention is particularly suitable for use at gasoline service stations as shown generally by the reference numeral 10 in FIG. 1. As shown, the service station has one or more islands 12 with a number of gasoline pumps 14 positioned on it and the entire area is covered with a canopy 16. A service facility or structure 18 is also provided under the canopies. The canopy covers the area where the vehicles 20 are parked to purchase gasoline. The canopy protects the customers and vehicles from the weather elements and also provides a safe, well-illuminated area for use at night.

Typically, a number of lights 21 are provided on the underside of the canopy 16 which project light downwardly for the customer's benefit. Not only does this allow the customer to use the facilities of the service station in a better manner, but also illuminates the entire service station and plaza area creating a is pleasant and safe haven for motorists in nighttime hours. The lighting also allows the service station to be seen by motorists at a considerable distance.

The canopy 16 has fascia areas around its perimeter which are approximately 1–3 feet in height and can be from 10–150 feet or more in width. These fascia areas are indicated by the numerals 22, 24, 26 and 28 in FIG. 1. Typically, only the fascia areas which are exposed to passing motorists and are visible from a distance are illuminated. The illumination allows the name of the service station to be highlighted and also can provide reference to some of the services and facilities of the station. Typically, at least two and in most cases three fascia areas of the canopies are illuminated. (The side of the canopy which faces away from the road is usually not illuminated.)

Figure 7:
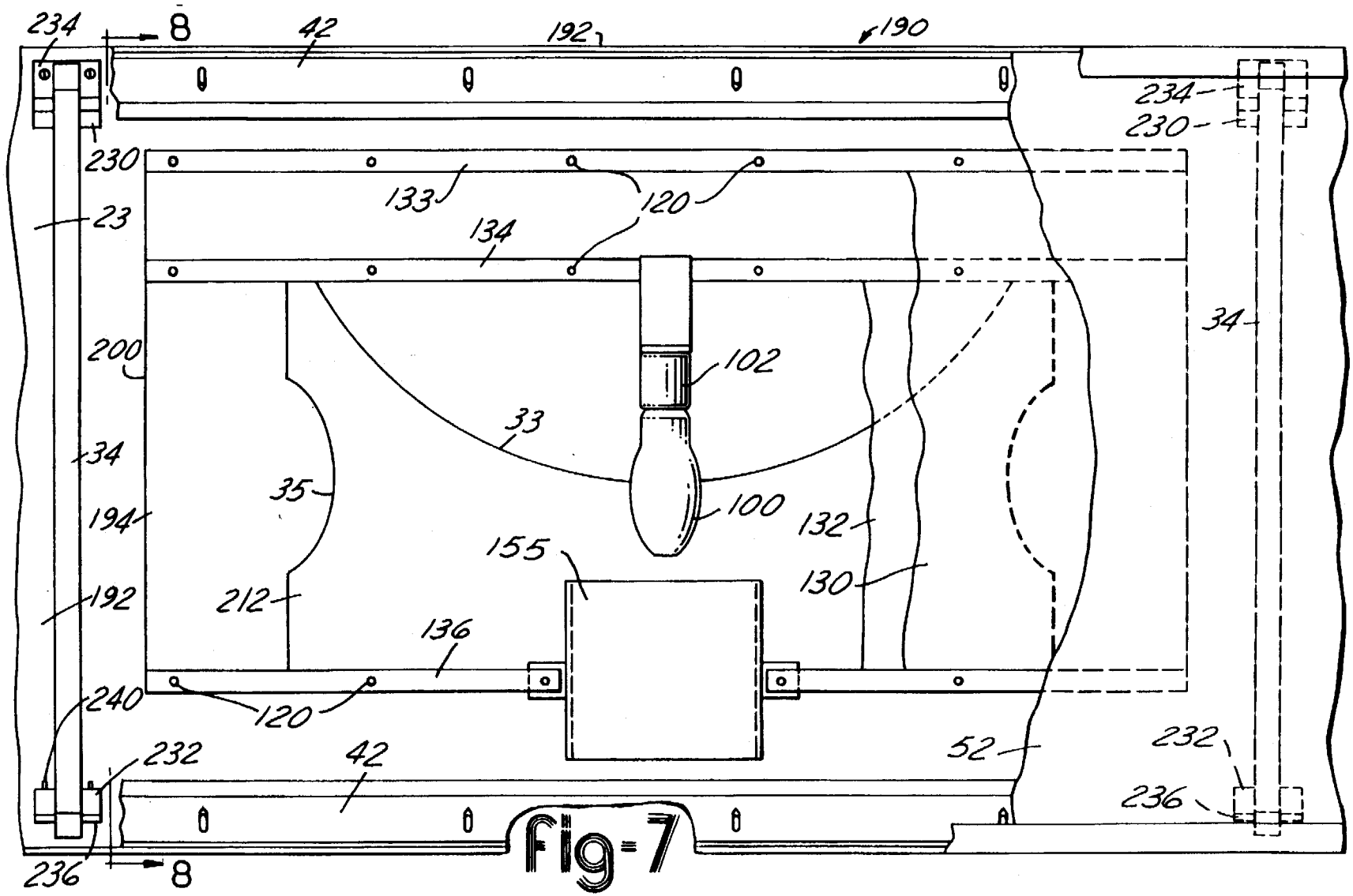
FIG. 7 illustrates in partial cross section the present inventive illuminated wall-mounted system.
Figure 8:
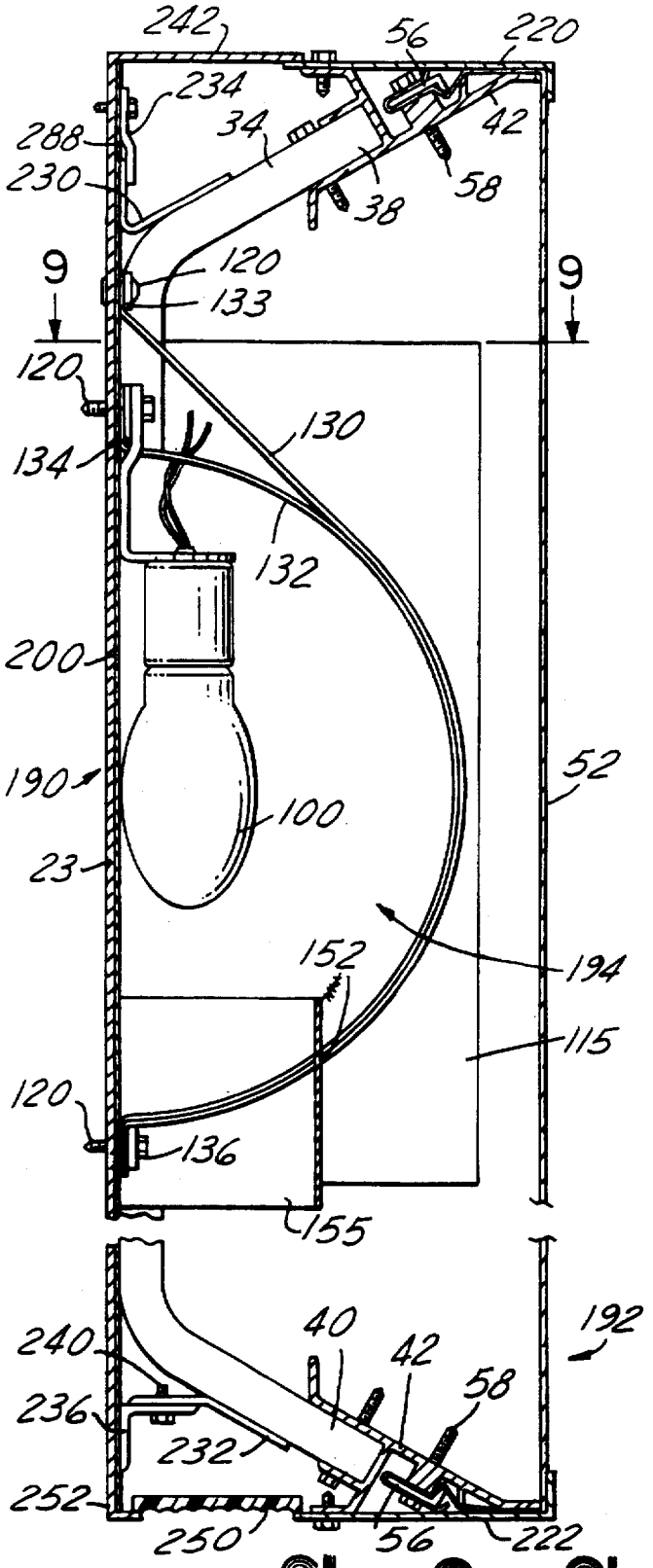
FIG. 8 is a cross-sectional view of the invention of FIG. 7, taken along lines 8—8 and in the direction of the arrows.
Figure 9:
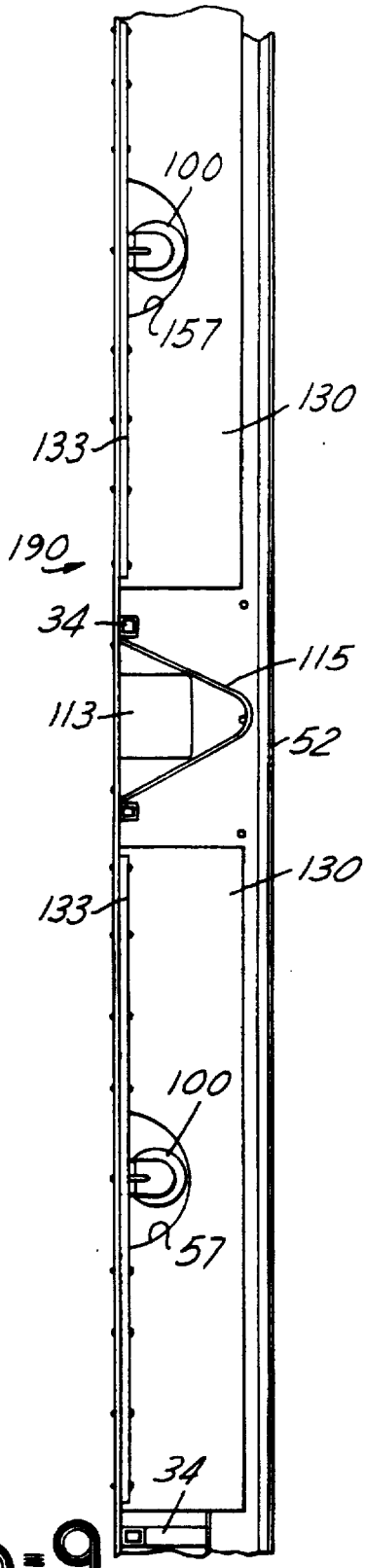
FIG. 9 is a cross-sectional view of the invention of FIG. 7, taken along lines 9—9 and in the direction of the arrows, and showing adjacent light/dispersion systems and accompanying ballast.

The present invention is not limited to canopy and fascia systems, however, it is understood that the present invention could also be used for rear illumination light box structures 190 which can be installed on the walls or surfaces 23 of the building 18 and provide the same highlighted and illuminated names and information that are provided on the canopy fascias described above. In fact, some service stations include an illuminated light box structure on the faces of its buildings over the entrances that are counterparts to the illuminated fascia light box systems on the canopies over the gasoline pumps. One embodiment of the invention designed for use on a wall or other vertical surface is designated by the reference numeral 190 and is discussed infra with reference to FIGS. 7–9.

Figure 2:
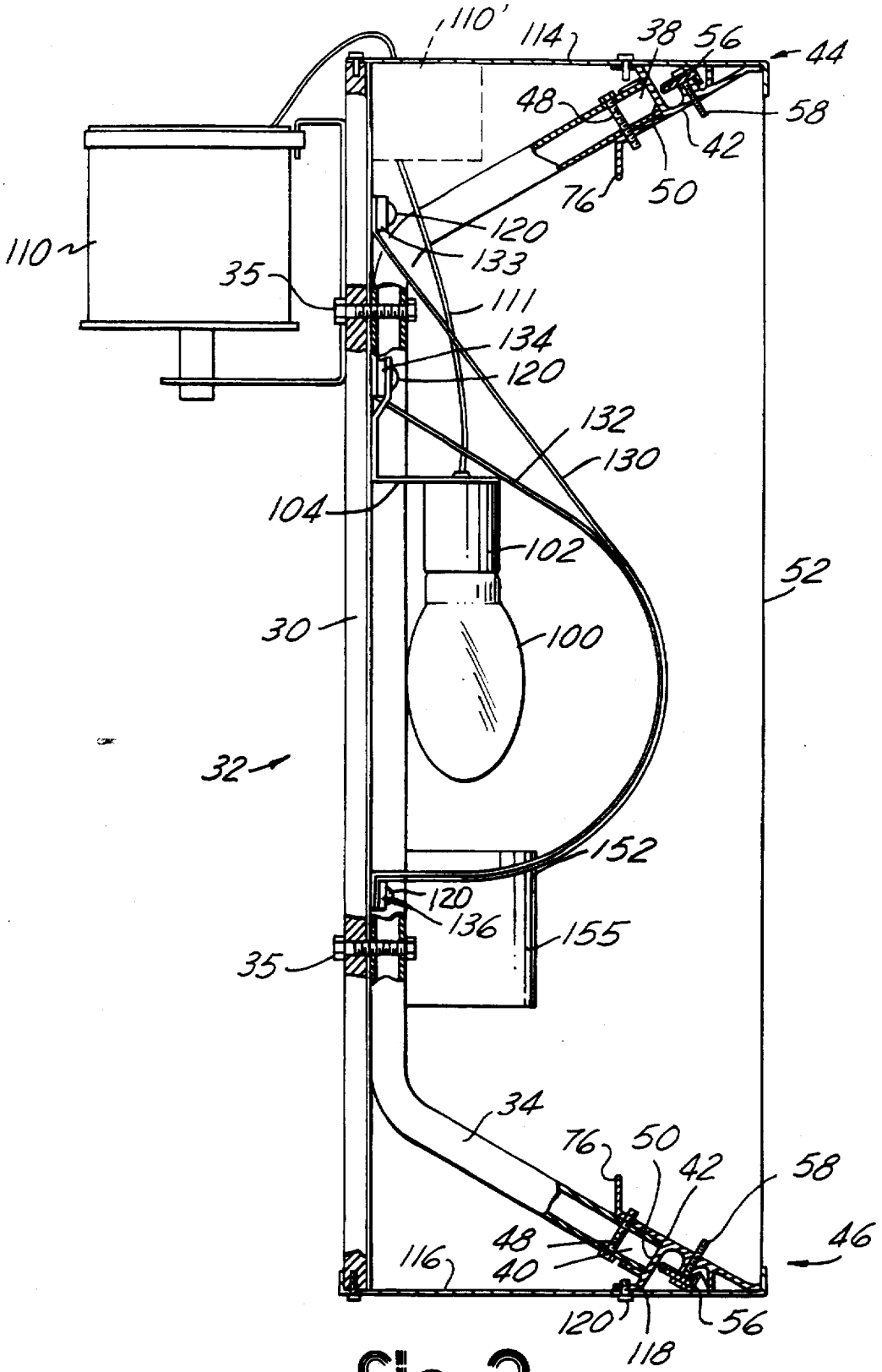
FIG. 2 is a cross-sectional view of the canopy and fascia system as shown in claim 1 when taken in the direction of arrows 2—2 of FIG. 1.
Figure 25:
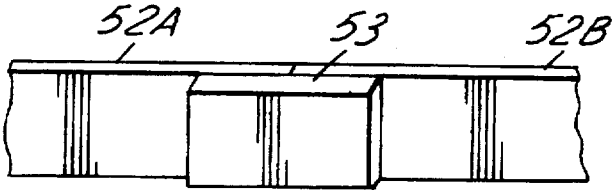
FIG. 25 depicts a joint between adjacent rigid front panel members.

The interior structure and configuration of the inventive light box structure is shown in FIGS. 25. The present invention is particularly adapted to be used on existing vertical or fascia structures, such as a wooden fascia board 30 as shown in FIG. 2. In the light box structure 32, a plurality of support brackets or tubes 34 are provided which are bolted or otherwise secured to the existing fascia 30. The support brackets 34 can be steel tubing and can be secured to the fascia system by a plurality of bolts 35 or any other conventional means.

The support brackets 34 are curved U-shaped structures and support elongated fascia frame extrusions 42 at their outer ends 38 and 40. The frame extrusions 42 provide the upper and lower edges of the illuminated fascia apparatus and are represented by reference numerals 44 and 46, respectively. The frame extrusions 42 are made from extruded aluminum in the shape shown in FIGS. 2, 3 and 5 and are attached to the ends 38 and 40 of the support bracket 34 by one or more self-drilling screws 48. The self-drilling screws eliminate drilling of either the frame extrusion or the support bracket at the field site. The extrusion 42 has a recess or channel So in which the ends 38 and 40 of the support bracket are positioned. Once the frame extrusions are positioned over a pair of support brackets, the support brackets are positioned in the channels 50 and secured in place with screws 48. The support brackets 34 in turn are secured to the fascia panel 30 and a solid secure unitary structure is formed on the fascia.

Positioned over the front of the light box structure 32 and held in place by the frame extrusions 42, is a translucent, flexible film panel 52. The panel 52 provides the illuminated facing of the fascias 22, 24, etc. of the canopy 16 of FIG. 1.

The sign panel 52 preferably is a durable, flexible, translucent material, such as Panaflex 940 or Panaflex 945 from the 3M Company and is stretched when it is installed. That material consists of a polyester scrim embedded between two layers of vinyl. Other similar materials could also be utilized such as Unitex and Ultralon Ultraflex materials, Cooley's Cooley-Brite materials, and Signtech's Superflex materials.

The names and letters 54 (FIG. 1) are preferably applied to the sign panel 52 and comprise a translucent pressure sensitive film. The preferred material in this regard is Scotchcal Series 3630 from the 3M Company. If desired, another protective layer of transparent film can be positioned over the names and numbers 54 for increased protection of the graphics. For example, a GPS protective film could be utilized for this purpose or a graphics protection film provided by 3M under the Scotchcal trade name could be utilized.

Alternatively, the front panel member 52 could be made of a thin non-flexible planar materials, such as acrylic, polycarbonate, or other transparent rigid plastic members. This panel member could be held on the front of the light box structure 32 by any conventional means, such as extruded members, channel members or spring clips. At the joint between two rigid panels 52A and 52B (FIG. 25) a clear support member 53 made from the same material could be utilized. The member 53 could be affixed to one of the two panels.

Figure 5:
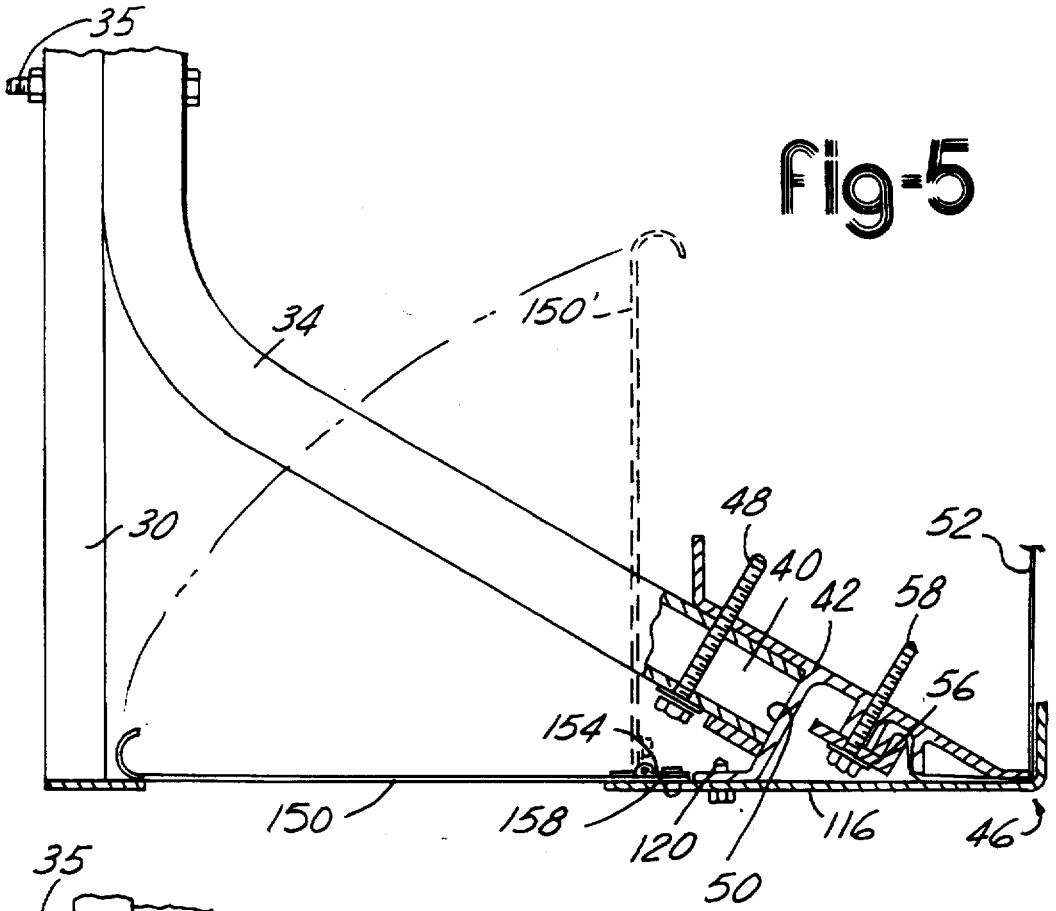
FIG. 5 is a cross-sectional view showing the access door for light source removal, and is taken in the direction of arrows 5—5 of FIG. 3.

A flexible sign panel 52 is stretched over the frame extrusions 42 and held in place as shown in FIGS. 2 and 5 by a tensioner angle extrusion 56. The extrusion 56 is made from extruded aluminum material, extends along the length of the frame extrusion, and is held in place with a plurality of self-drilling screws 58. As shown, the flexible film 52 is wrapped around the angle extrusion 56 so that it is held tightly in place under tension when the screws 58 are installed in place.

The flexible film 52 is also held tightly in place under tension at the shorter ends of the light box. These ends are illustrated by the reference numerals 60, 62 and 64 in FIG. 1; end 62 is shown in detail in FIG. 4. In this regard, the ends of all of adjacent light box structures 32 are tensioned and held in place at the shorter edges in the same manner. Thus, references to light box 32 on one side of the fascia for canopy 16 would apply similarly to the light box structures on the other fascias of the canopy.

The front panel or sheet member 52 can be stretched over the structure and held in place on the frame extrusion 42 in any conventional manner. Preferably, however, the sheet member is stretched over the front surface with a movable trolley as disclosed in co-pending U.S. patent application Ser. No. 251,592, filed on May 31, 1994, the disclosure of which is hereby incorporated by reference. That application is commonly assigned to the same assignee as the present invention.

In accordance with application Ser. No. 251,592, a frame-like trolley structure is positioned on the canopy fascia frame structure. A roll of sign panel material is positioned on a spindle which is held in place on the trolley frame structure by a pair of collar members. A roller member is provided to assist in applying the material onto the face of the frame structure. One of the collar members is adapted to firmly hold the spindle from rotating under certain conditions. A handle member is provided to allow rotation of the spindle and thus tightening and stretching of the flexible face sign panel. A plurality of clamping members is provided on the frame structure to lock the trolley in position as desired along the frame structure while a portion of the sign panel is being stretched and installed.

Figure 4:
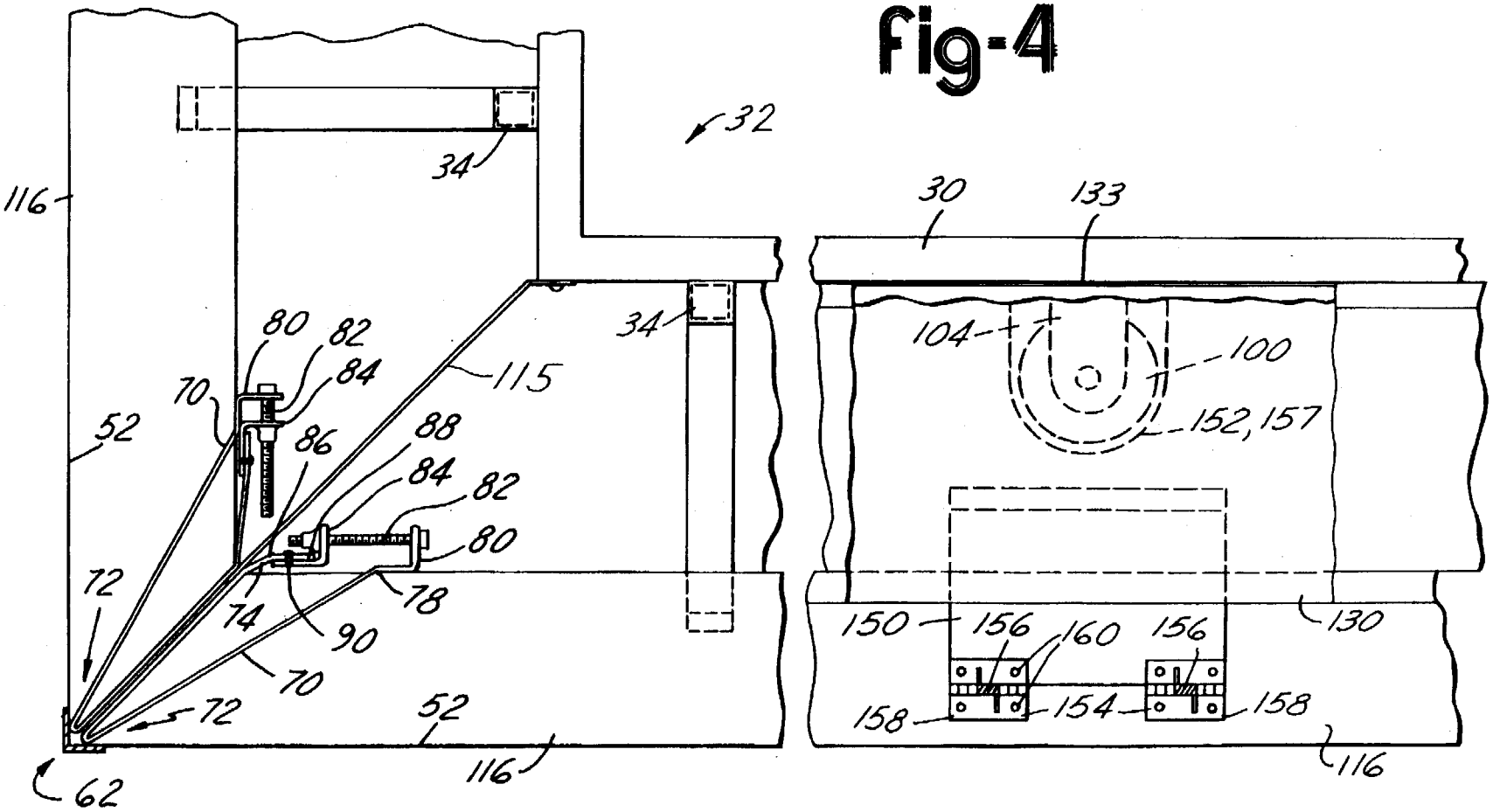
FIG. 4 is a cross-sectional view illustrating the inventive corner assembly of the present invention.

A corner structure in accordance with the present invention includes a bent metal support member 70 (see FIG. 4). The corner 72 of the support member protrudes into and forms the corner 62 of the light box structure. The support member 70 is attached at one end 74 to flange 76 on the frame extrusion 42 (see FIG. 2). The second end 78 of the support member 70 is also attached to the flange 76 of the frame extrusion 42. The angle of the support member 70 allows light from the light source, as described below, to reach the corners 62 and still provides a strong solid support for the sign panel 52 at the corner.

Bracket 80 is also attached to the end of the support member 70. Bracket 80 is adapted to hold a tensioning screw 82 and a second tensioning bracket 84. The end 86 of the flexible sign panel 52 in turn is wrapped around a elongated member 88 and secured by a self-drilling screw 90 to the bracket 84. Any other conventional fastener, such as a nut and bolt, could also be utilized. In this manner, when the end 86 of the film 52 is held in place by brackets 88 and 84, the bolt 82 can then be tightened which pulls the film 52 tightly in place in the corner 62.

A shield 92 is secured to the fascia structure 30 and extends outwardly at an angle. The shield is positioned between adjacent light boxes on a canopy and prevents light from one light box from entering an adjacent light box. The shield 92 preferably is made from a thin sheet of reflective aluminum material, or is coated with a reflective material.

Figure 26:
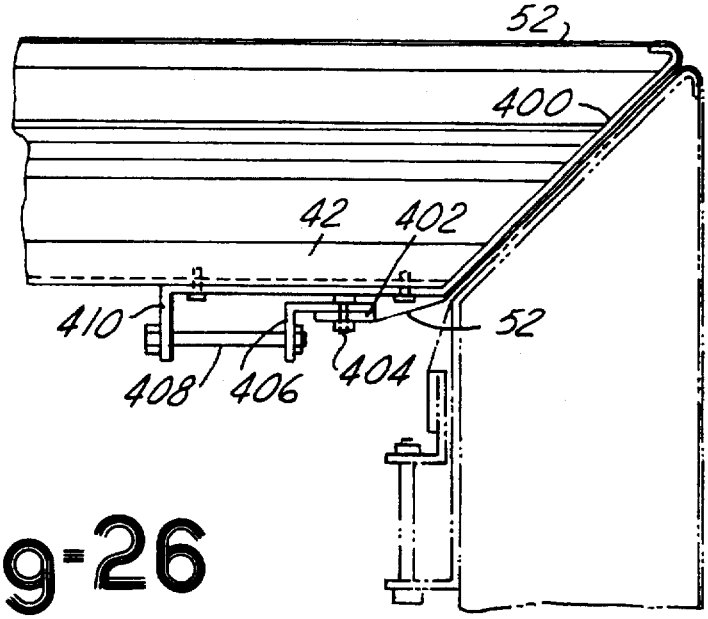
FIG. 26 illustrates an alternate corner assembly for use with the present invention.

An alternate corner assembly is shown in FIG. 26. A bent metal support member 400 is attached to the frame extrusions 42 at the ends thereof. The front panel 52 is wrapped around elongated member 402 which is then attached by conventional nut and bolt fasteners 404 to angle bracket 406. The angle bracket 406 is attached to flange 410 on member 400 by threaded bolt 408. The panel 52 is stretched and tightened at its ends by turning and tightening of bolt 408 which in turn pulls angle bracket 406 closer to flange 410.

Figure 3:
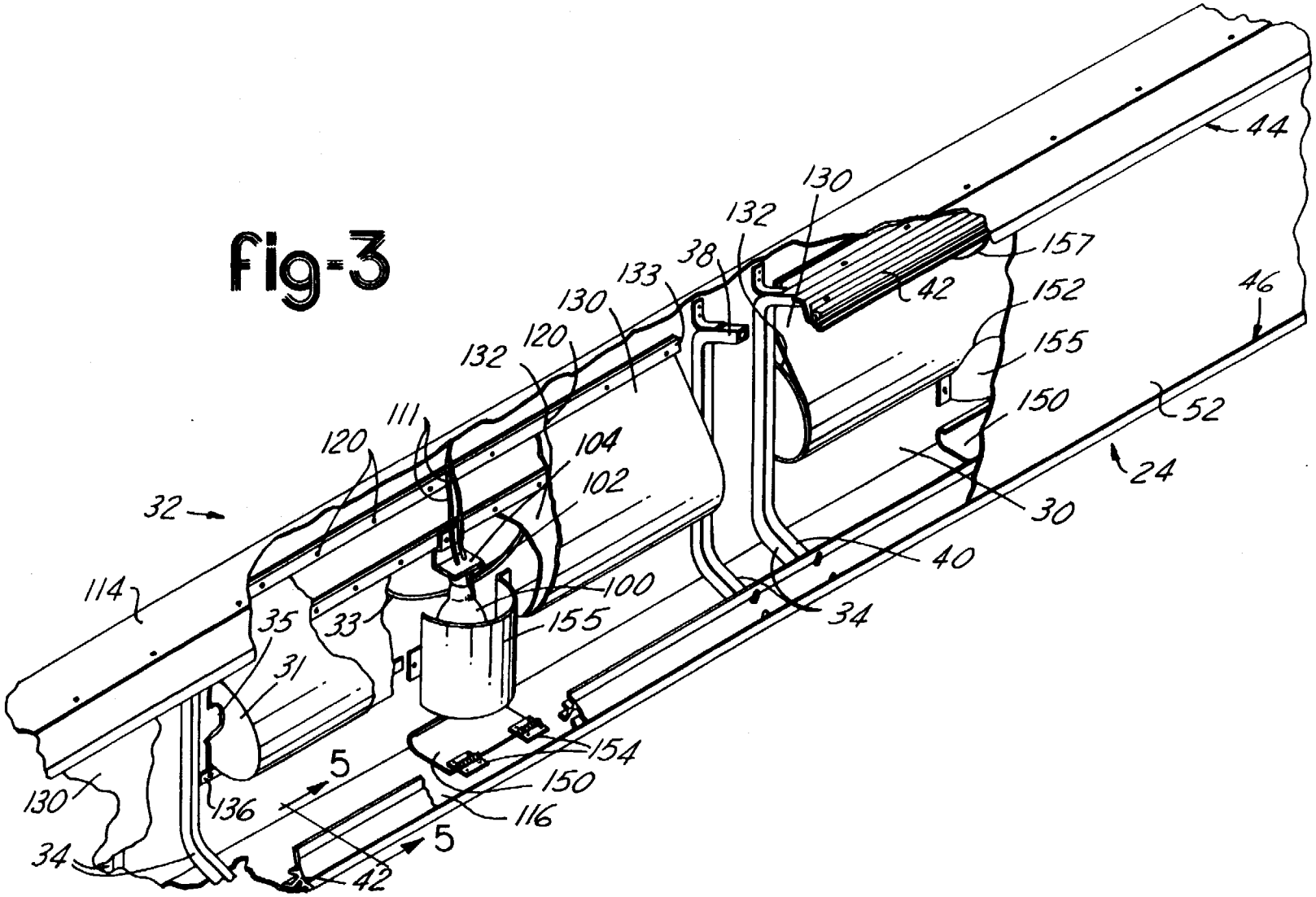
FIG. 3 is a perspective view of the interior of the fascia light box apparatus illustrating various features of the invention.

The light source for the illuminated canopy and fascia system is shown in FIGS. 2 and 3. A plurality of metal halide lights (or lamps) 100 are positioned along the fascia panel 30. The lights 100 are screwed into conventional light sockets 102 which are connected to the fascia panel 30 by brackets 104.

The metal halide lights are preferably high intensity discharge (HID) lights. These are more efficient and provide more lumens per watt of energy than regular light bulbs. Preferably, metal halide lamps of 150–175 watts are utilized for the illuminated canopy and fascia system. With lights of this intensity, the lamps 100 can be provided every five to nine feet along the length of the fascia, and preferably every 8 feet. The spacing of the lights provides for better energy consumption and light output. Not only do the metal halide HID lights 100 provide a more efficient light source for a canopy and fascia system, but the individual light bulbs are easier to service and replace, as explained below.

It is also possible in accordance with the present invention to use light sources other than metal halide lamps to provide the necessary illumination. Such light sources could be conventional incandescent lamps, mercury vapor lamps, other HID lamps, although a point light source is necessary. "E-lamps" and neon lamps could also be utilized. Metal halide lights are preferred due to their color temperature properties, operating properties in temperature extremes, lumens/watt and rated lamp life.

In order to reduce operation and replacement costs, the sizes of the light sources should be kept as small as possible. In this regard, a balance might need to be made between the spacing and size of the light sources which would provide the desired illumination intensity and distribution, and which also would minimize operating and replacement costs.

One or more ballasts 110 are provided for the metal halide lights. The size and number of ballasts will depend on the sizes and number of light sources utilized and the illumination intensity desired on the sign panel 52. The ballasts are of a conventional type and do not need further explanation or description here. A ballast can be provided on the opposite side of the fascia panel 30 from the lights 100 if there is sufficient space (as shown in FIG. 2), or the ballast can be positioned internally along an inside edge of the light box (as shown by phantom lines 110' in FIG. 2). Conventional wiring 111 is used to connect the lights to the ballasts and the ballasts in turn to a plug or power source (not shown).

If necessary to minimize shadows and provide better light distribution on the face of the film 52, the angle or positioning of the lights 100 relative to the fascia 30 can be changed or adjusted as desired. For example, the lights 100 could be set at horizontal or vertical angles relative to the fascia to eliminate shadows caused by support brackets, ballasts or other internal structures.

A pair of elongated aluminum trim caps are provided to enclose the interior of the light box apparatus. The trim caps comprise an upper panel member 114 and a lower panel member 116. The caps can be attached to the ends of the fascia panel 30 when needed as well as to a flange 118 on the fascia extrusions 42. The connection of the top and bottom trim caps 114 and 116 to the fascia panel and frame extrusions 42 can be with any conventional means, such as self-drilling screws 120.

A light dispersion panel 130 is provided around each of the metal halide light sources 100. Panel 130 distributes the light uniformly on the inside surface of the sign panel 52. Preferably, the light dispersion panel 130 is the Varalume patterned film product produced by TIR Systems Ltd. in British Columbia, Canada. The Varalume film product has a plurality of openings on the face of the film, the openings being sized and arranged in a certain pattern designed for allowing differing amounts of light to pass through the film at different areas.

The light dispersion panel can be curved, flat or any other shape depending on the configuration of the light box structure and/or desired distribution of light.

The pre-specified pattern of light openings can also be made and provided in any conventional manner. The light dispersion panel 130 is preferably a thin sheet of a clear plastic or similar material with a pattern of small light-blocking dots or areas of opaque material which prevent light from passing through the material at desired locations. The pattern has a greater density of light-blocking dots in front of and adjacent to the point light source, and graduates into areas of lesser density of dots near the outer edges of illumination provided by the light source. The specific pattern of dots is dependent on the size and dimensions of the area to be illuminated and the desired uniformity or pattern of illumination desired on the translucent front panel member.

The light dispersion panel 130 can also be covered by a translucent ink or dye which varies in density depending on the amount of light desired to be transmitted through the panel in particular areas. For example, the density could have a linear distribution from a high density area adjacent the light source to a low density area at the edges of the panel.

The light dispersion panel 130 could also be made from a thicker material and could be self supporting, although this could add additional expense to the device. The light openings also could be actual holes or apertures formed in an otherwise opaque panel member, the holes being positioned to allow varying amounts of light to pass through the panel in different areas, depending on the illumination pattern desired on the front panel of the light box structure.

Another method for diffusing illumination from light sources and spreading it evenly over a surface is shown and described in U.S. Pat. No. 4,267,489.

The light dispersion panels 130 can be formed as curved structures (as shown in FIG. 2) around each of the light sources 100 and positioned between the light sources and the flexible front panel 52. To keep the curved film 130 in position and prevent it from sagging and thus changing the light dispersion pattern, a curved support member 132 is provided. The support member 132 can be made of any conventional clear plastic material which satisfies the functions and purposes of the present invention, but preferably is a clear polycarbonate material approximately 0.030 inches in thickness.

Both the film 130 and support members 132 are connected to the fascia panel 30 by elongated rigid strip members 133, 134 and 136. The elongated edges of the film and support members are bent (e.g. by an angle break) to provide a flat portion adjacent the strip members. Conventional fasteners, such as self-drilling screws 120, are positioned through the film, support members and strip members and used to secure the film and support members to the fascia. The strip members should have a low profile to eliminate shadows or light blockages which might affect the light distribution on the sign panel.

In order to increase the evenness and intensity of the light distribution on the front panel 52, a reflective surface 31 is provided on the fascia 30 behind the light sources 100. The surface 31 could be coated with a highly reflective paint (such as white), or a type of mirrored specular reflector could be provided (such as bright aluminum reflector film). Preferably, the reflective surface reflects at least 90% of the light. In order to provide better reflectivity of the system, it is preferable to paint or coat all of the interior parts or members of the light box structure with similar paint or film. This could be done by elastostatic powder coating. A matte white coating preferably is utilized rather than a glossy white coating in order to provide better diffusion of the light rather than straight reflection.

If necessary to minimize shadows caused by the light sockets 102, a curved half-moon portion 33 of the fascia immediately behind the light sockets could be left uncovered by the specular reflective surface. Similarly, curved surfaces 35 could be provided in the ends of the reflective surface if necessary to provide a more uniform light dispersion pattern on the front panel.

One of the features of the invention is that the lights 100 can be easily and quickly replaced when they burn out. For this purpose, a hinged access door 150 is provided in the bottom 116 of the light box structure. If a curved dispersion panel is utilized, then a curved opening or cutout 152 is also provided in the light dispersion panel 130 and in the curved backing member 132. These are shown in FIGS. 3–5.

An access door 150 and opening 152 are provided in axial alignment with each of the metal halide lights 100 (as shown in FIG. 3). The access door 150 is connected by hinges 154 so it can be opened to position 150' (shown in phantom in FIG. 5). The hinge plates 158 pivotably attached to the door 150 are attached to trim cap member 116 and door 150 by pop rivets 160. Preferably, a conventional biasing spring 156 (as shown in FIG. 4) is provided in the hinges 154 so that the door 150 will automatically return to its closed position after the light bulb has been replaced. In this manner, the light bulb can be replaced from the ground with an elongated pole device which can be inserted manually up through the door 150 and the door will return to its closed position after the pole and light bulb are removed.

Pole type light bulb replacement devices with spring biased fingers and the like which are used to grip a light bulb so it can be unscrewed and removed are conventionally known and available. Of course, other types of light bulb removing devices and configurations of access openings through the fascia structure can be utilized in accordance with the scope of the present invention.

A sleeve 155 can be positioned in the opening 152 to facilitate replacement of the light bulb without damaging the film 130 and support members 132. The sleeve 155 preferably is a U-shaped member made of aluminum and is connected to the fascia 30 by screws or other conventional fasteners. The sleeve 155 also can prevent formation of a shadow pattern on the front panel caused by the edges of the opening 152.

Although a cutout 152 access opening is preferably provided in the panel 130 and backing member 132 for removal and replacement of the lights 100, it is also possible in the alternative to have the bottom edges of the panel 130 and backing member 132 be removably attached to the fascia 30. In this manner, when a light 100 needed replacement, access through door 150 and detachment of panel 130 and backing member 132 from the fascia could also be easily and conveniently made.

A cutout opening 157 is preferably provided in the panel 130 and backing member 132 above the light source for temperature control or relief (see FIGS. 3 and 4). This opening 157 may not be necessary in all cases, and depends on the intensity of the light source and the power provided.

Figure 6:
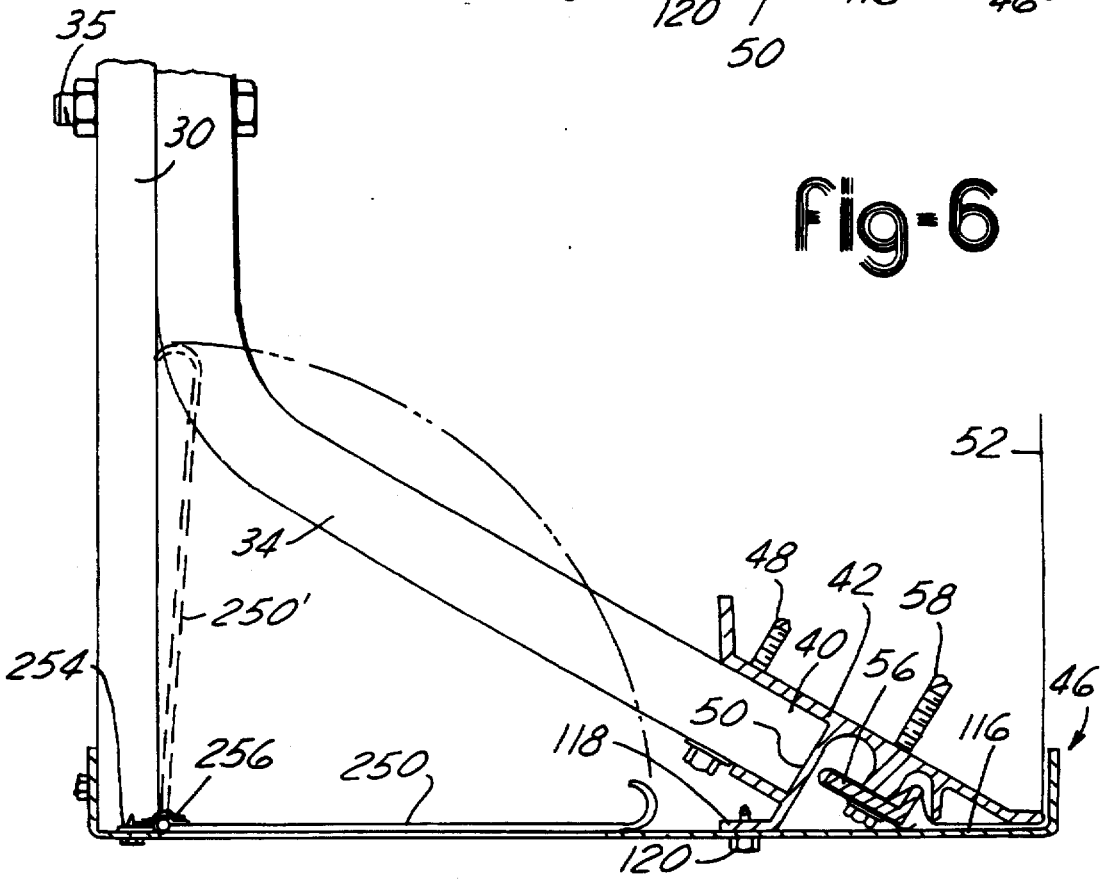
FIG. 6 illustrates an alternate access door embodiment.

FIG. 6 shows an alternate embodiment of an access door 250. In this embodiment, the door 250 is pivoted around pivot pins or hinges 254 and opens in the opposite direction to door 150 shown in FIG. 5. Preferably, door 250 is biased by spring 256 to its closed position.

It is also possible in accordance with the present invention to provide access doors or panels which open or pivot in any other conventional manner. For example, the access doors could open downwardly from the lower surface of the device and be secured with a conventional "push-release" latching mechanism. In this manner, when access to the interior of the device is desired, a force applied quickly to the surface of the door releases the latch and allows the door to open. The door is closed by repeating that same procedure. Other conventional latching mechanisms, such as magnetic closures, could also be utilized. With any of these mechanisms or systems, however, it is preferred that the access door or member fits tightly or securely against the housing so that light cannot escape through any cracks, and so that dust, dirt, water, insects and the like cannot enter the housing.

It is also understood that although access to the lights from the ground is preferable in accordance with the present invention, it is also possible to provide the access doors, panel members, or other openings on any other side or surface. In addition, access to the lights from the top or side is probably necessary with the structures shown in FIGS. 17–19. If desired, it is also possible to provide hinges along the edges of one or more of the front, top, bottom or side surfaces in order to provide access to the light sources. This might result in increased material, assembly and maintenance costs, however.

Figure 10:
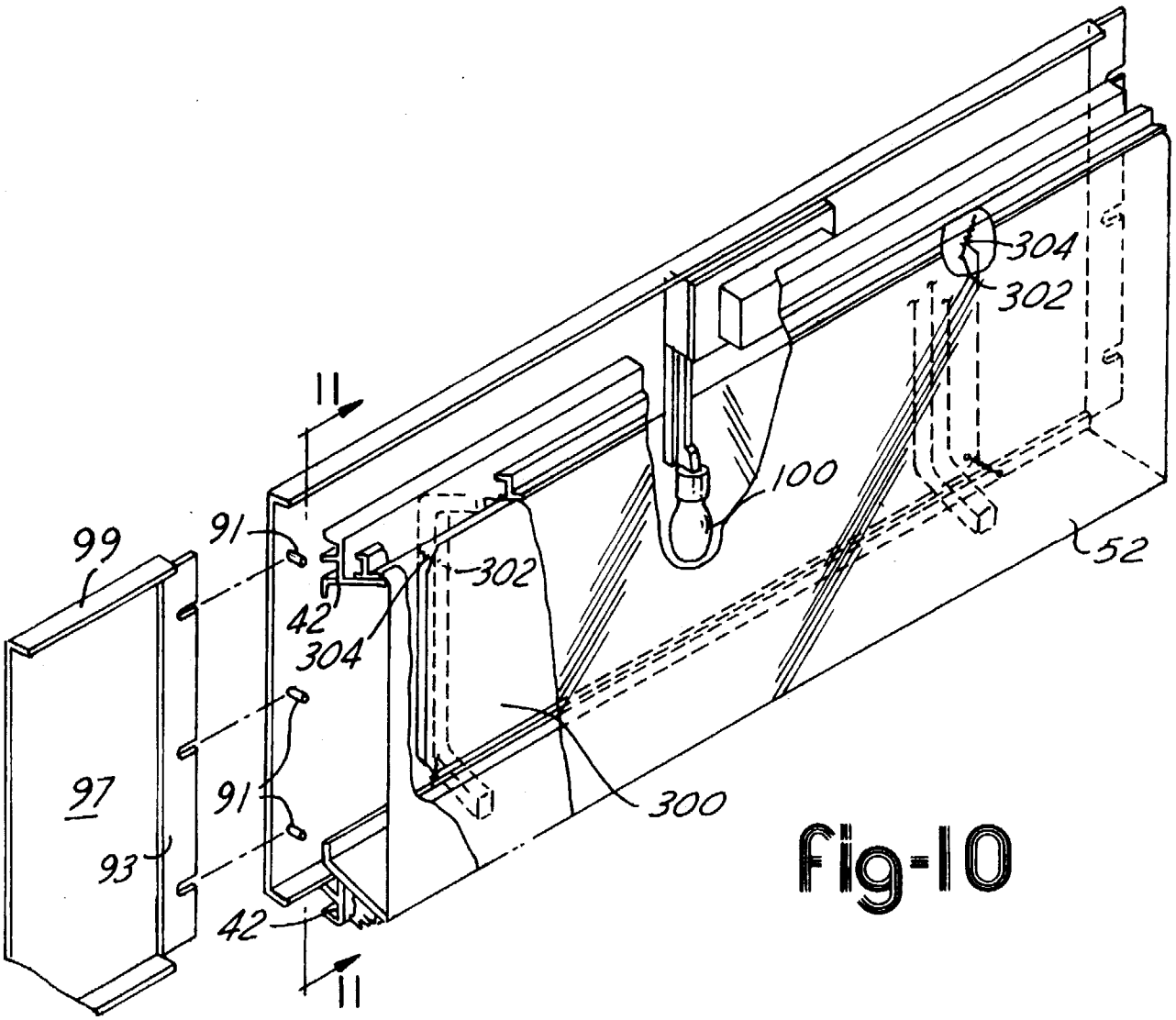
FIG. 10 is a perspective view of an alternate embodiment of the inventive illumination system.
Figure 11:
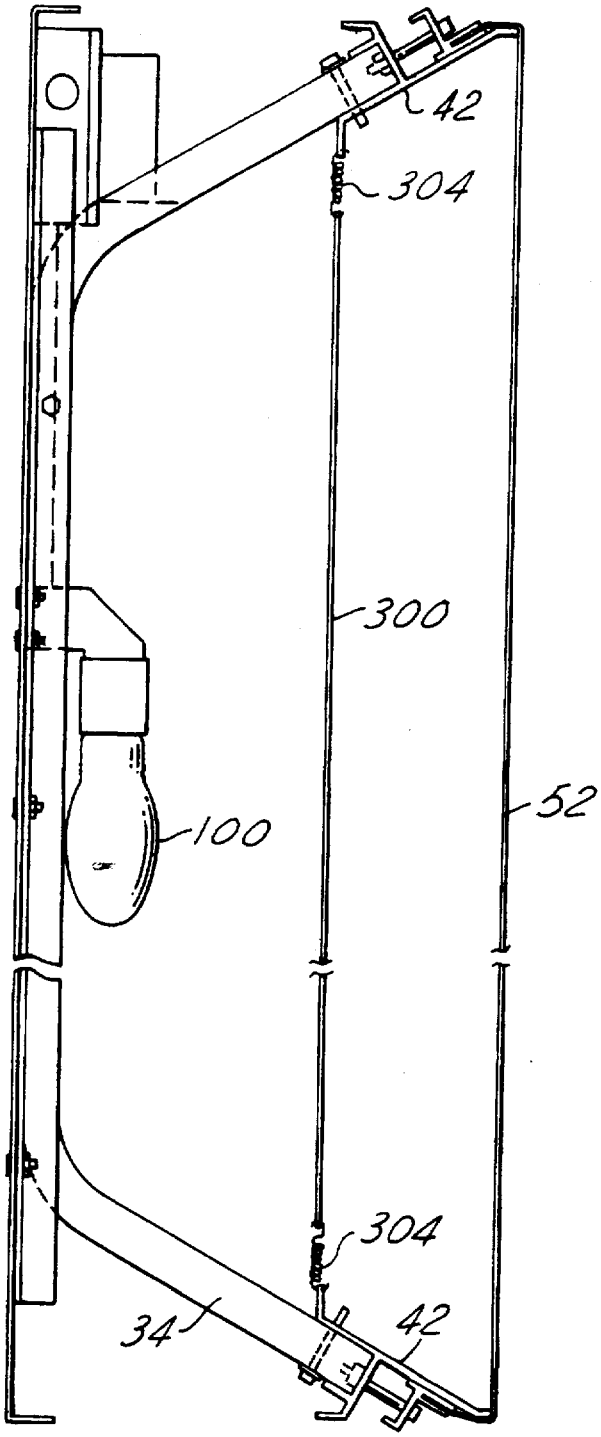
FIG. 11 is a cross-sectional view of the embodiment shown in FIG. 10 taken along line 11—11 and in the direction of the arrows.

An alternate embodiment of the invention is shown in FIGS. 10 and 11. In this embodiment, the light dispersion panel 300 is flat or planar and is suspended between the light sources 100 and the front translucent panel member 52. The panel 300 has a series of mounting openings 302 in the corners and is suspended by a plurality of spring fasteners 304 from the elongated frame extrusions 42 of the light box structure. Protective grommets are provided in the openings 302.

Figure 12A:
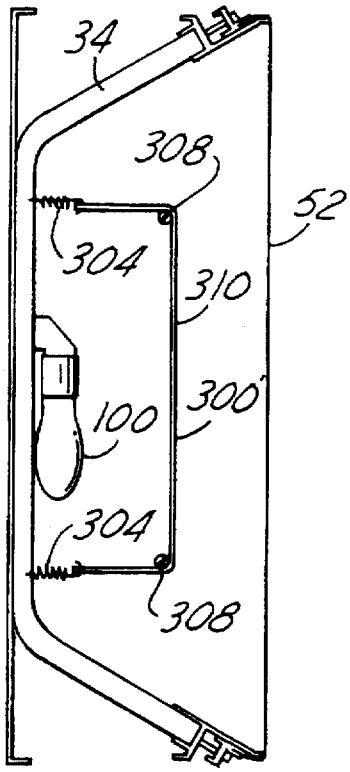
FIGS. 12*a* and 12*b* illustrate alternative embodiments of the light dispersion panel member for use in the present invention.
Figure 12B:
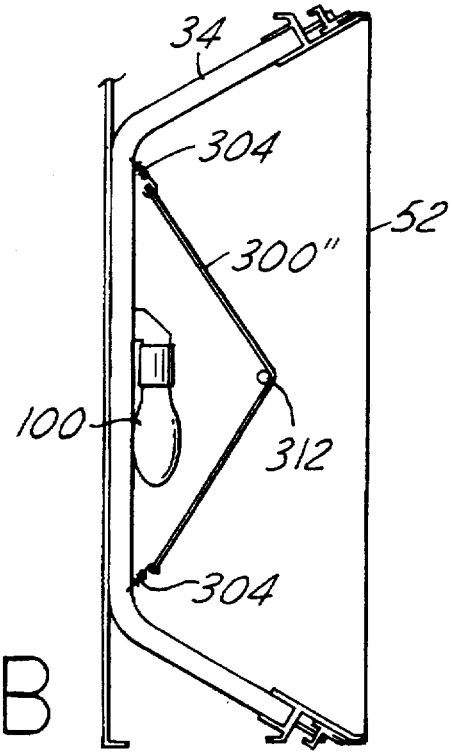

It is also possible for the dispersion panel 300 to be held in position in any other conventional manner, such as attached to a separate frame, or attached directly to the sides of the light box. In addition, the light dispersion panel can be provided in other shapes and configurations, such as those shown in FIGS. 12*a* and 12*b*. In FIG. 12*a*, the panel 300' is attached over two elongated rods or cables 308, and the pattern of light openings is only provided on the front surface 310. In FIG. 12*b*, the light dispersion panel 300" has an angled shape and is attached over one elongated rod or cable 312.

Figure 13:
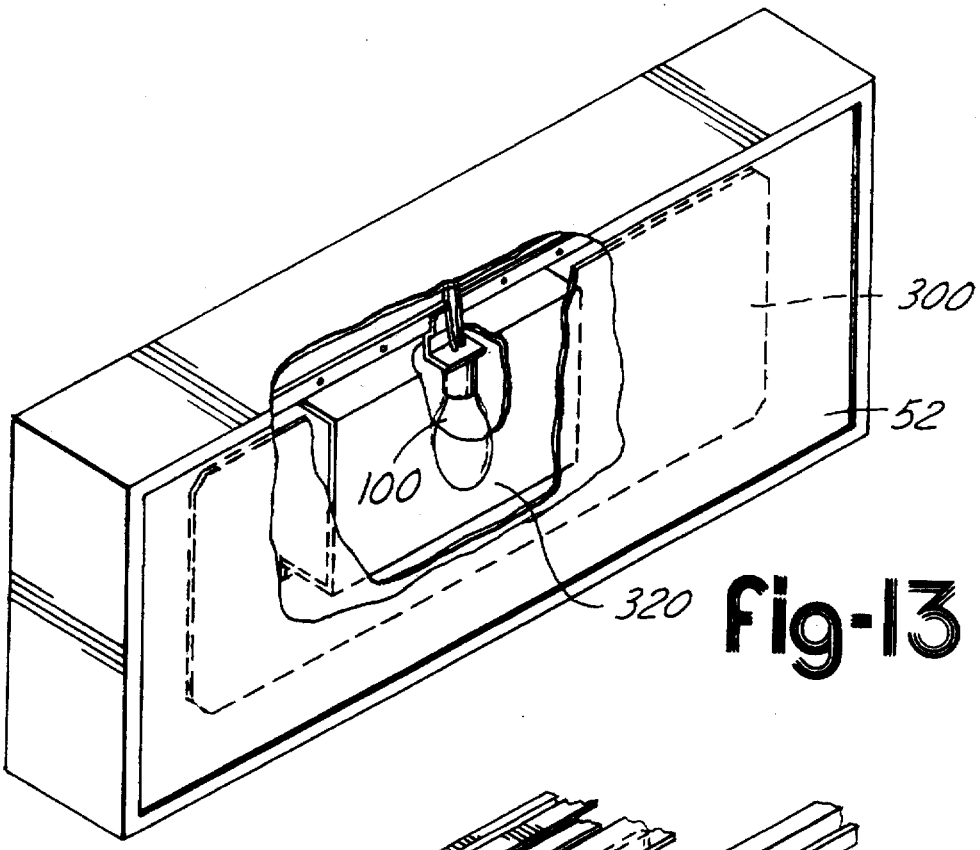
FIG. 13 depicts the use of an alternate diffusion member with the present invention.

It is also possible to provide a separate diffusion lens 320 between the light source 100 and dispersion member 300 in order to help eliminate bright and dark spots and thus provide a more uniform distribution of light on the front panel member 52. This is shown in FIG. 13. Diffuser lens of this type are well known and typically are made from a plastic material. An additional lens of this type will add additional cost to the project and also may reduce the brightness or intensity of the light on the front panel.

For ease of transport and assembly, the back and illumination portion of the light box structure can be made from a plurality of modular units joined together as shown by reference number 99 in FIG. 10. The backing member 97 has an offset flange 93 at one end which mates with posts 91 positioned at the other end of an adjacent module.

Figure 27:
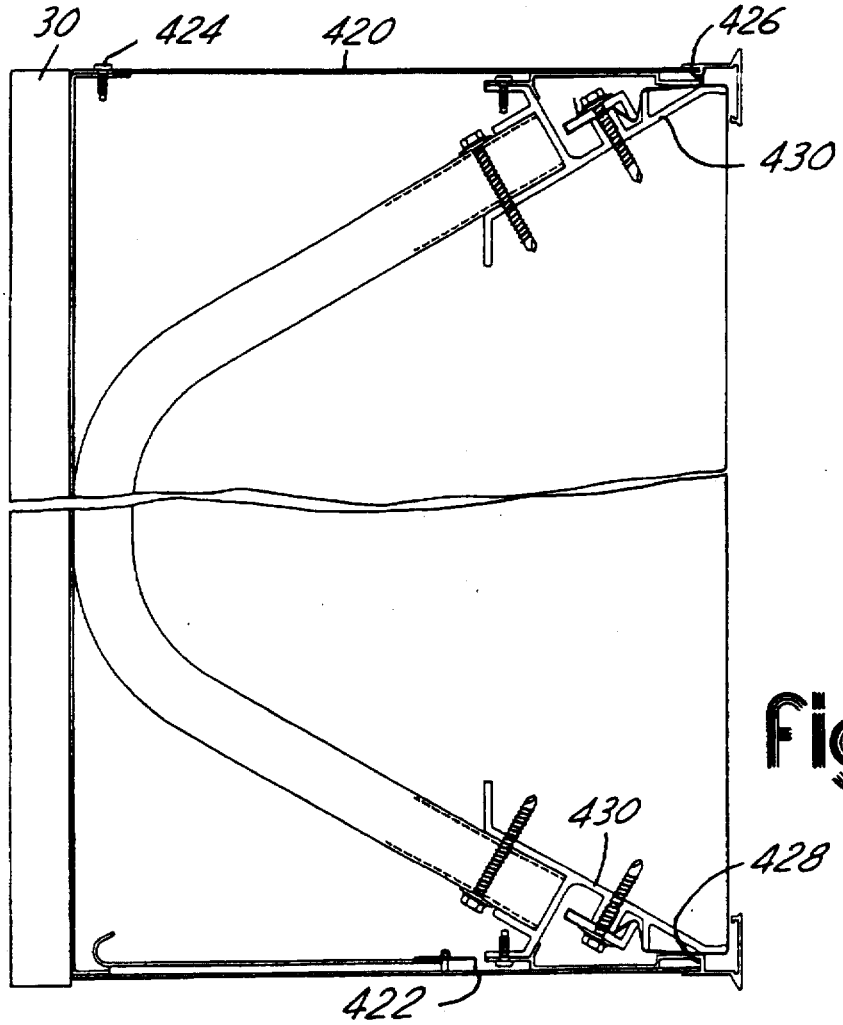
FIG. 27 illustrates an alternate embodiment utilizing alternate top and bottom trim cap structures.

An alternate embodiment with different trim cap members 420 and 422 is shown in FIG. 27. The trim cap members are attached by screws or other conventional fasteners 424 at the edges adjacent the building fascia 30, and positioned in elongated grooves or channels 426 and 428 in the frame extrusion members 430. This embodiment facilitates ease of assembly of the light box structure, and also minimizes the number of fasteners which might be visible or which might allow openings for moisture into the housing or openings for light leakage from the housing.

Wall-mounted light boxes 190 in accordance with the present invention are shown in FIGS. 1 and 7–9. These structures contain many of the basic concepts and features of the invention as described above, but is modified for mounting on the walls or other surfaces 23 of the building 18. The light box 190 includes an exterior housing 192 and a light/dispersion film system 194. Typically, the light/dispersion film system is first installed in place on the building and then the housing 192 is installed in place covering and enclosing the light/dispersion film system.

The light/dispersion film system 194 includes one or more metal halide lights (or lamps) 100 of the type and nature described above with reference to FIGS. 1–5. The lights 100 are installed in conventional sockets 102 which are affixed to the building surface 23 and powered by a conventional ballast 113. The ballast is positioned between two adjacent light/dispersion systems and placed within a cover member 115 (see FIGS. 8 and 9).

The lights 100 are positioned behind light dispersion film 130 and covered support member 132. The film 130 and support member 132 are separately connected to the building surface 23 at their upper ends by elongated strip members 133 and 134. The edges of the film and support members are bent in the configurations shown for this purpose. Fasteners, such as self-drilling screws 120, are used to connect the strip members to the building surface.

The lower edges of the film 130 and support members 132 are connected together and secured to the building by strip member 136. Alternately, the lower edges of the film and support member can be connected together by an L-shaped bracket which is adapted to fit in a channel in a corresponding bracket attached to the building, in much the same manner as the angled bracket 230 fits in the channel 288 of bracket 234 as discussed below and shown in FIG. 8. In this manner, the lower edges of the film and support member could be selectively disconnected from the building when it was desired to change the light 100.

The film 130, support member 132, and brackets 133, 134 and 136 are preferably about 5–6 feet in length and are mounted as a group on the building or other wall surface 23 as shown in the drawings. Preferably, for ease of installation on site at the building, the film 130, support member 132, brackets 133, 134, and 136, and light socket 102 are premounted at the factory or off-site on a separate metal sheet or panel 200. Then, at the building site, the panel 200 with these items mounted on it is installed in place as a modular unit or system.

When a flat light dispersion sheet 300 is desired (see FIGS. 10–11), the modular unit merely comprises brackets 133, 134, 136 and light socket 102 mounted on panel 200. After the modular unit is installed in place and the support brackets 34 and frame members 42 are assembled as part of the light box structure, the dispersion sheet 300 is suspended by springs 304 from the flanges 76 on the frame members 42 (see FIG. 11).

A specular reflector member 212 can be positioned on the surface 23 or panel 200 behind the lights 100—in the same manner and for the same reasons as discussed earlier. Preferably the reflector member is highly specular and reflects a minimum of 90% of the light. If desired, for better light dispersion, the member 212 also can have a curved portion 33 ("halfmoon" shaped) behind the upper part of the light, as well as curved portions 35 at each end of the reflector member, as discussed above, which are not reflective.

Preferably, a cut-out opening 152 is provided in the lower portions of the curved-type of light dispersion panel 130 and support member 132 for removal of the light (as described above), rather than providing selectively detachable bracket members. Sleeve members 155 are also provided in the cut-out opening for the purposes and reasons as described above.

It is also possible to provide in the wall-mounted unit 190 a flat dispersion panel 300 similar to that described above with reference to FIGS. 10–11. The flat panel is suspended, positioned, and held in place in the same manner as described earlier. An appropriate pattern of light openings or spaces is provided on the dispersion panel to provide even and uniform light from the light sources or sources on the front panel member.

It is also possible to put a separate lens around each of the point light sources in the wall-mounted unit similar to those described above with reference to FIG. 13 and for the same purpose.

The exterior housing 192 of the wall-mounted unit 190 is preferably assembled as a separate modular unit and then installed in place on the surface 23 after the light/dispersion film system 194 is affixed to the surface 23.

The housing 192 includes a pair of U-shaped support brackets 34 and a pair of elongated frame extrusion members 42 which are mounted to the outer ends 38 and 40 of the brackets 34. As in the fascia light box embodiment described above with reference to FIGS. 1–5, the frame extrusions 42 are made from extruded aluminum in the configuration shown and provide the upper and lower edges of the light box.

A translucent, flexible film panel 52 is stretched over the frame extrusions 42 and held in place by angle extrusion 56 and screws 58. The panel 52 provides the surface for advertising or informational messages desired by the business establishment.

Preferably, the support brackets 34, frame extrusions 42, film panel 52 and panel members 220 and 222 (FIG. 8) are assembled together as a separate modular unit (although they could be mounted and installed separately on the building surface 23 if desired). In order to install the modular housing 192 on the building or other wall surface, corresponding sets of brackets are provided. Angled brackets 230 and 232 are mounted on the upper and lower portions of the support brackets 34. Clip bracket 234 and rest bracket 236 are mounted on the wall or building surface 23. When the modular housing 192 is installed, the brackets 230 are nested within channels 288 in clip brackets 234, and then the brackets 232 are positioned on rest bracket 236. Thereafter, brackets 232 and 236 are secured together by fasteners, such as self-drilling screws 240.

In order to complete the exterior housing structure for the light box 190, elongated panel member 242 is secured to the building surface and mates with the panel member 220. Conventional end caps or panels are provided made from aluminum sheet material or the like are provided on the two side ends of the light box (not shown).

On the lower surface of the light box 190, one or more elongated clear glass or plastic panels 250 are provided. The panels 250 are supported by panel member 222 and bracket 252 attached to the building and allows illumination from the light 100 to project downwardly from the light box 190 on the building or wall surface.

Also, in order to change the light 100, the panels 250 can be easily lifted or removed so that a hand or tool can be extended upwardly between the bracket 252 and panel member 222.

Figure 14:
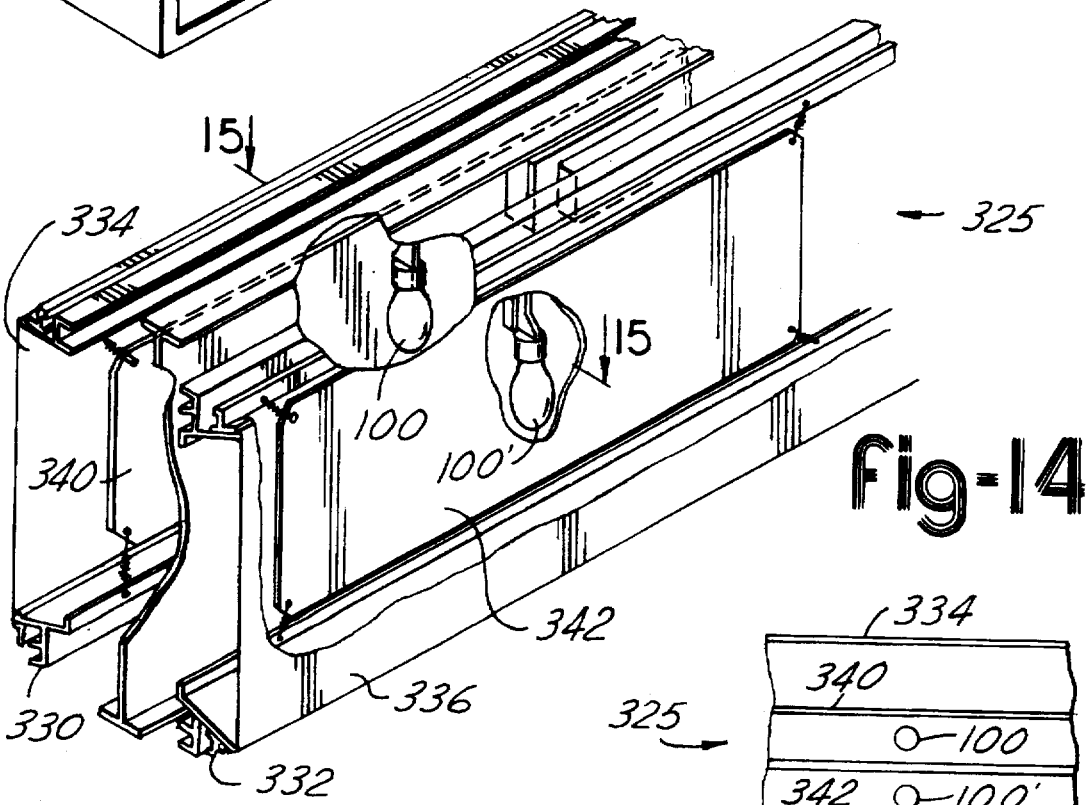
FIG. 14 is a perspective view of a further embodiment of the invention.
Figure 15:
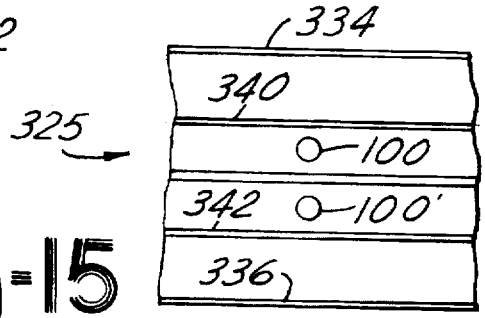
FIG. 15 is a cross-sectional view of the embodiment shown in FIG. 14 taken along line 15—15 and in the direction of the arrows.

In accordance with the scope and significance of the present invention, it is also possible to provide embodiments of the invention which utilize the unique light dispersion and distribution feature in structures of various other shapes, sizes and configurations. For example, FIGS. 14 and 15 illustrate an illumination system 325 which is two sided. Two opposed housings 330 and 332 are provided. The housings have transparent panels or sheet members 334 and 336 and are separately illuminated by separate point light sources 100 and 100'. A pair of light dispersion panels 340 and 342 are suspended or mounted between the lights 100 and 1001 and the front panel members 334,336 in order to evenly distribute the light on the inside of the translucent sheet members.

The two-sided system 325 could be free-standing or mounted on a pole or other structure. It would provide two uniformly lighted advertising or promotional panels for viewing by customers or the passing public. Access doors or panels similar to those described above for removal and replacement of the lights are preferably provided in the housing. It is also possible to provide a single removable panel or access opening for the system.

Figure 16:
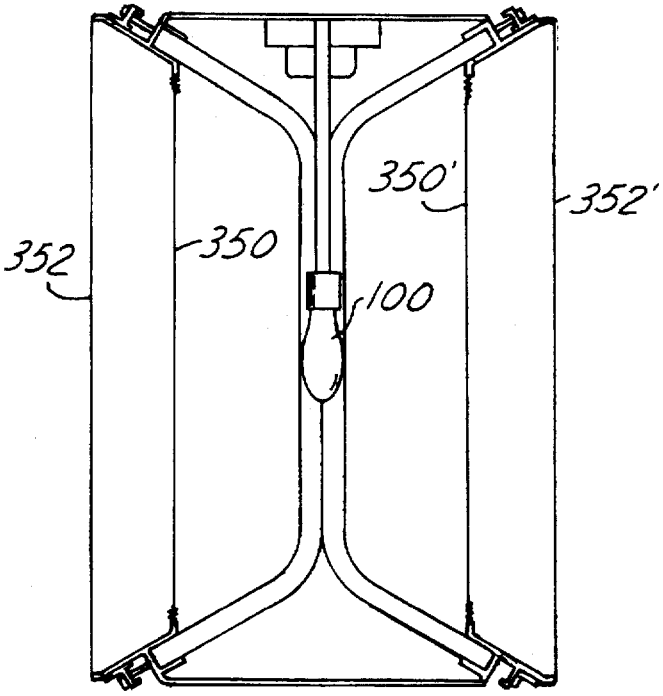
FIG. 16 depicts still another embodiment of the present invention.

It is also possible to utilize a single light source 100 positioned inbetween two light dispersion members 350, 350' and two translucent panel members 352,352' as shown in FIG. 16.

Figure 17:
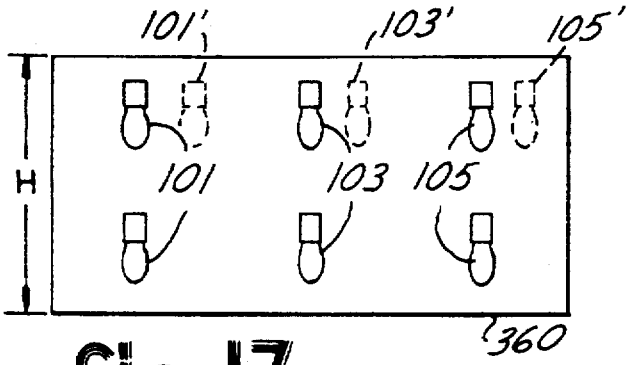

The present invention is also not limited to rectangular light box devices. Other devices which can utilize the present invention are shown in FIGS. 17–20. In FIG. 17, the device 360 has a height H which requires pairs of point light sources 101,103,105 to be positioned vertically in order to provide the required illumination on the entire front surface of the device.

Figure 18:
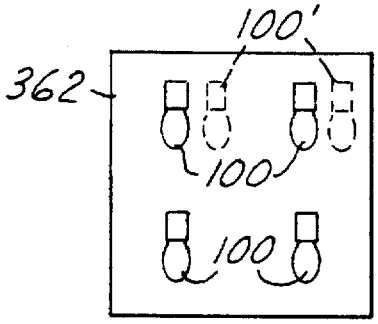
FIGS. 17–20 illustrate additional sizes and configurations of illuminated light boxes in accordance with the present invention.
Figure 19:
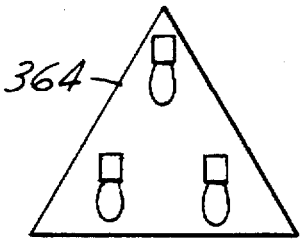
Figure 20:
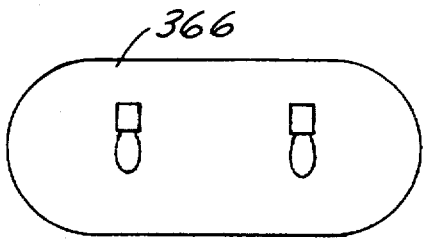

Other structures or devices which can utilize the present invention are shown in FIGS. 18–20 and indicated by reference numerals 362,364 and 366, respectively. These devices provide square, triangular and circular (or oval) structures, respectively. In each of these devices, an appropriately designed light dispersion sheet or panel member is provided and positioned between the light sources and the translucent front panels in order to evenly distribute the light across the full height, width and length of the front panel members.

In order to more easily remove and replace the light sources in structures of the type shown in FIGS. 17 and 18, it is possible to vertically stagger the light sources, such as in the manner shown in dotted lines as 101', 103' and 105' in FIG. 17 and as 100' in FIG. 18. A staggered alignment allows easier access to the light sources from the bottom of the structures (and thus from the ground). An offset of either the upper or lower light sources a small distance, such as 2–3", should be sufficient. Also, the upper row of light sources could be set at a slight angle for ease of changing from the ground. In this manner, the same access doors could be utilized to change all of the rows of light bulbs. Also, the changing pole could have a swivel or universal head on it to facilitate angled light bulb removal.

Figure 21:
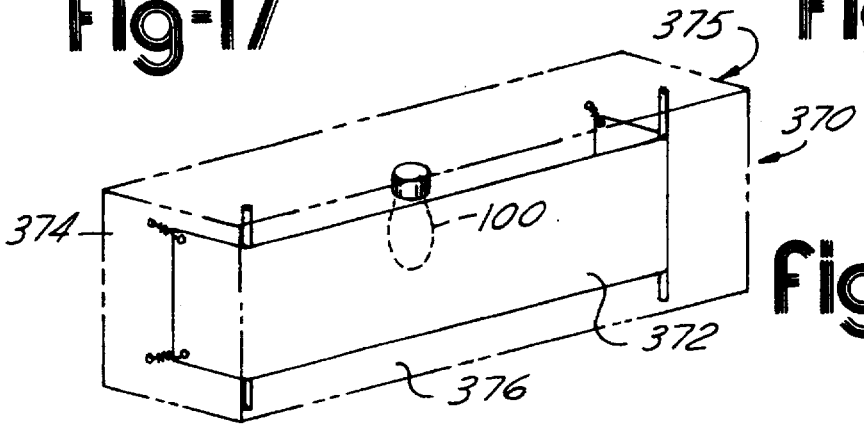
FIGS. 21–24 illustrate embodiments of the invention which have additional translucent panel members.

In addition, the present invention is not limited to structures or devices which only illuminate the front panel. For example, with an appropriately designed and configured light dispersion member, light from a point light source could be directed along one or more of the sides (top, bottom, ends, etc.). A device 370 which provides illumination on both ends of the light box is shown in FIG. 21. In this device 370, the light dispersion member 372 is curved as shown in order to provide uniform distribution of light on the side/end surfaces 374 and 375 as well as the front panel member 376. The side/end surfaces 374,375 are made from the same material with the same properties as the material forming the front panel member 376 and are attached in the same manner. In this regard, all three surfaces 374,375 and 376 could be covered by the same piece of material which is stretched and anchored to cover all three areas.

Figure 22:
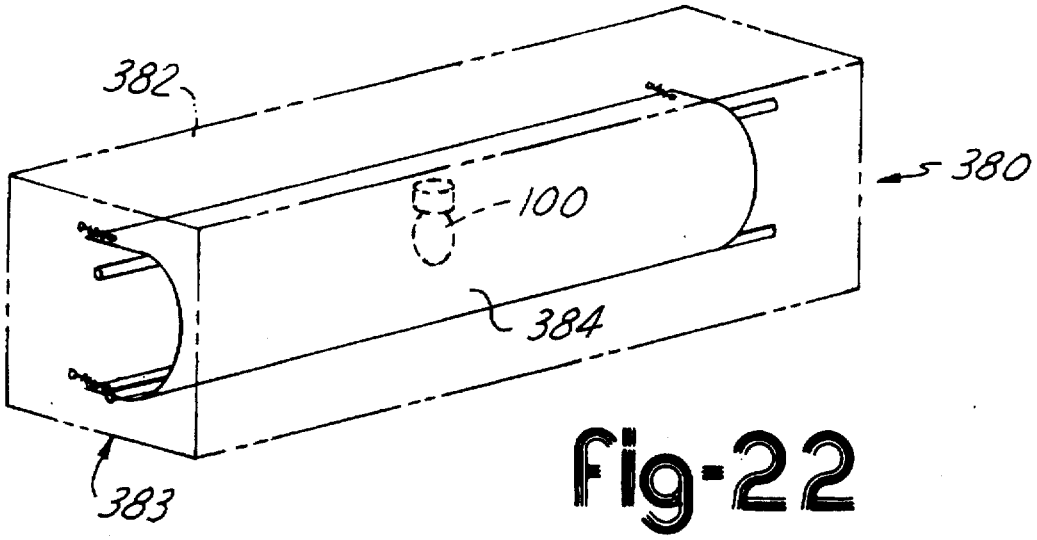

A device 380 which provides illumination on the top and bottom surfaces of a light box structure as well as the front surface is shown in FIG. 22. Either the top surface 382 or the bottom surface 383, or both, could be covered by a translucent panel member and illuminated in the same manner as discussed above. An appropriately curved and patterned light dispersion member 384 is provided adjacent the light source 100 in order to evenly distribute the light on all of the desired translucent outer panel members.

Figure 23:
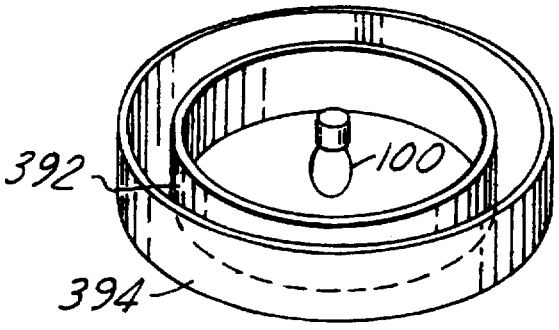
Figure 24:
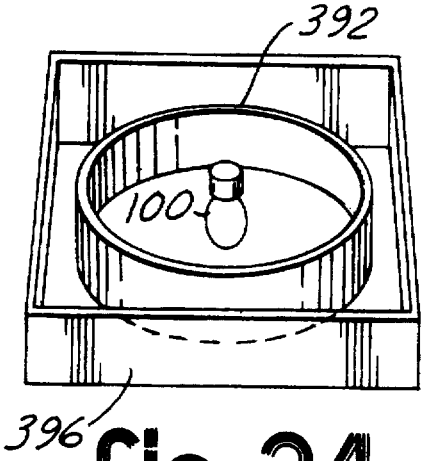

Further, in accordance with the present invention, it would be possible to provide an internally illuminated light box structure which provides illumination from any or all of the six sides of a polygonal structure, or any or all of the numerous sides of any possible geometric structure in which the invention is utilized. For example, as shown in FIG. 23, a circular light box 390 is provided having a central light source 100 surrounded by a circular light dispersion member 392 and an outer circular translucent panel member 394. Also, as shown in FIG. 24, a circular light dispersion member 392 could be used with a polygonal-shaped translucent panel member 396.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

What is claimed is:

1. An illuminated fascia light box apparatus for mounting on a surface comprising:

a plurality of support brackets for attachment to said surface;

a pair of elongated frame members attached to said support brackets and forming external face edges of said apparatus;

a pair of corner members, a first corner member attached to one end of said pair of frame members and a second corner member attached to the other end of said pair of frame members;

a flat translucent sheet member stretchably extending and secured at its edges by said pair of frame members and said pair of corner members;

at least one metal halide light positioned in said apparatus and providing illumination through said translucent sheet member; and a light dispersion member positioned between said light and said sheet member for distributing illumination from the light uniformly on said sheet member.

2. The illuminated fascia light box apparatus of claim 1 wherein said frame members have channel means for containing ends of said support brackets therein.

3. The illuminated fascia light box apparatus of claim 1 wherein said light dispersion member has a substantially planar configuration.

4. The illuminated fascia light box apparatus of claim 1 further comprising an access door in said apparatus adjacent said light so that said light can be removed and replaced.

5. The illuminated fascia light box apparatus of claim 4 wherein said access door is hinged and spring biased to the closed position.

6. The illuminated fascia light box apparatus of claim 1 wherein said sheet member has a design thereon which is highlighted when the light is illuminated.

7. The illuminated fascia light box apparatus of claim 1 wherein at least two light box apparatus are provided on the fascia of a service station canopy.

8. The illuminated fascia light box apparatus of claim 2 further comprising self-drilling fastener means for securing sa d frame members to said support brackets.

9. The illuminated fascia light box assembly of claim 1 wherein said corner members comprise a bent piece of spring material and at least one tensioning means for tensioning said sheet material.

10. An illuminated fascia light box apparatus for mounting on a surface comprising:

a plurality of support brackets for attachment to said surface;

a pair of elongated frame members attached to said support brackets and forming two external face edges of said apparatus;

a pair of corner members, a first corner member attached to one end of said pair of frame members and a second corner member attached to the other end of said pair of frame members;

a translucent panel member extending between said pair of frame members and said pair of corner members;

at least one point light source positioned in said apparatus and providing illumination through said translucent panel means;

a light dispersion member positioned between said point light source and said translucent panel member for distributing illumination from the light uniformly on said panel member, said light dispersion member having a plurality of areas to allow light to pass therethrough, said areas arranged in a prespecified pattern to allow differing amounts of light to pass through at different portions of said light dispersion member and thereby create a uniform distribution of light on all portions of the translucent panel member; and access means for manually accessing said point light source from below and outside said light box apparatus for replacement.

11. The illuminated fascia light box apparatus of claim 10 wherein said frame members have channel means for containing ends of said support brackets therein.

12. The illuminated fascia light box apparatus of claim 10 wherein said light passage areas on said light dispersion member comprise openings.

13. The illuminated fascia light box apparatus of claim 10 whereby said light passage areas on said light dispersion member comprise translucent spaces.

14. The illuminated fascia light box apparatus of claim 10 wherein said light dispersion member has at least one elongated planar flat surface.

15. The illuminated fascia light box apparatus of claim 10 wherein a plurality of point light sources are provided.

16. The illuminated fascia light box apparatus of claim 15 wherein said light sources are positioned in at least two rows.

17. The illuminated fascia light box apparatus of claim 10 wherein said access means comprises a movable panel which can be opened for access to said light source.

18. The illuminated fascia light box apparatus of claim 10 wherein said translucent panel member comprises a stretchable sheet member.

19. The illuminated fascia light box apparatus of claim 10 wherein said light dispersion member has a substantially planar shape.

20. The illuminated fascia light box apparatus of claim 10 wherein said light box apparatus has a non-rectangular shape.

21. The illuminated fascia light box apparatus of claim 10 wherein said light box apparatus has a curved translucent panel member.

22. An illuminated system comprising:

a housing, said housing having a generally rectangularly shaped box structure with four elongated sides and two shorter ends;

elongated translucent panel member positioned on at least two elongated sides of said housing and attached to said box structure;

at least one point light source in said housing for projecting light;

light dispersion means for distributing light from said point light sources uniformly on said elongated translucent panel member; and access means on said housing for accessing said point light source from below and outside said housing;

said light dispersion means having a plurality of light passages arranged in a prespecified pattern to allow differing amounts of light to pass through the film at different areas and thereby create a uniform distribution of light on all portions of each of said translucent panel members.

23. The illuminated fascia light box apparatus of claim 22 wherein said two elongated sides are positioned on opposite sides of said housing.

24. The illuminated fascia light box apparatus of claim 23 wherein two rows of point light sources and two light dispersion means are provided, one of each of said rows of point light sources and light dispersion means positioned adjacent each of said translucent panel member.

25. The illuminated fascia light box apparatus of claim 22 wherein each of said light dispersion means has at least one elongated flat panel portion.

26. The illuminated fascia light box apparatus of claim 22 wherein said access means comprises at least one movable panel member.

27. The illuminated fascia light box apparatus of claim 26 wherein one movable panel member is provided for each point light source.

28. An internally illuminated sign comprising:

an elongated housing bounded by upper and lower sides, said housing having at least one open portion, an elongated translucent panel means covering said open portion, at least one row of point light sources positioned in said housing, a light dispersion panel means positioned between said point light sources and said translucent panel means for distributing light from said point light source uniformly over at least an elongated portion of said translucent panel means and between said upper and lower sides and, access means in said lower side of said housing for allowing access to said point light sources from outside and below said housing, said housing further comprising a plurality of support brackets attached to said housing, a pair of elongated frame members attached to said support brackets and forming elongated edges on said elongated sides, and said translucent panel means being mounted on said frame members.

29. The internally illuminated sign of claim 28 wherein said light dispersion panel means has a substantially planar configuration.

30. The internally illuminated sign of claim 28 wherein said light dispersion panel means has a plurality of light passages, said passages being sized and arranged in a pre-specified pattern in order to allow differing amounts of light from said point light sources to pass through said light dispersion panel means at different portions and achieve said uniform distribution of light.

31. The internally illuminated sign of claim 30 wherein said light passages comprise openings in said light dispersion panel means.

32. The internally illuminated sign of claim 30 wherein said light dispersion panel means comprises a thin sheet member and said light passages comprise translucent areas in a patterned film.

33. The internally illuminated sign of claim 28 wherein two open portions are provided on said housing, a translucent panel means is positioned to cover each of said open portions, and a light dispersion panel means is positioned between said point light sources and each of said translucent panel means.

34. The internally illuminated sign of claim 28 wherein two rows of point light sources are provided.

35. The internally illuminated sign of claim 34 wherein said rows of point light sources are positioned horizontally one above the other.

36. An internally illuminated light box comprising:

an elongated housing, said housing having an upper elongated panel member, a lower elongated panel member, a rear panel member, and an open front portion, an elongated flexible planar translucent sheet member stretched over and covering said open front portion, said translucent sheet member having a length in its elongated direction and a width laterally to said elongated direction;

a plurality of point light sources in said housing, said light sources positioned uniformly in a spaced apart relationship on said rear panel member and substantially centrally between said upper elongated panel member and said lower elongated panel member, light dispersion means positioned between said point light sources and said translucent sheet member, said light dispersion means having at least one flat planar surface, and at least one access panel member in said lower elongated panel member for allowing access to said point light sources from outside and below said housing, whereby light from said point light sources is distributed uniformly over the entire width and length of said elongated translucent sheet member.

37. The internally illuminated sign of claim 36 wherein at least two rows of point light sources are provided in the housing.

38. The internally illuminated sign of claim 36 wherein said light dispersion means comprises a substantially planar member and is suspended in said housing between said upper and lower elongated panel members.

39. The internally illuminated sign of claim 36 wherein a separate movable panel member is provided adjacent each of said point light sources.

40. The internally illuminated sign of claim 36 wherein said light dispersion means comprises a sheet member.

41. The internally illuminated sign of claim 36 wherein said light dispersion means comprises a panel member having a plurality of light passages spaced in a predetermined manner to allow differing amounts of light to pass through said passages.

42. The internally illuminated sign of claim 41 wherein said light passages comprise apertures in said panel member.

43. An internally illuminated sign comprising:

an elongated housing means substantially rectangular in shape and bounded by upper and lower elongated sides and a pair of shorter end members, said housing having a rear member and an open front portion and being greater than ten feet in length, an elongated flexible planar translucent panel member stretched over and covering said open front portion, at least two point light sources positioned in said housing and providing illumination for said translucent panel member, said point light sources being spaced between five to nine feet apart, light dispersion member positioned in said housing between said point light sources and said translucent panel member, said light dispersion member having a plurality of light passages arranged in prespecified patterns adjacent each of said point light sources to allow differing amounts of light to pass through the light dispersion member at different areas, whereby a light pattern of substantially uniform intensity is created along and across the entire translucent panel member.

44. The illuminated sign as set forth in claim 43 further comprising frame members positioned substantially around the perimeter of said open front portion and wherein said translucent panel member is stretched over said frame members.

45. The illuminated sign as set forth in claim 43 further comprising access means in said lower elongated side of said housing for providing access to replace said point light sources.

46. An internally illuminated sign assembly for a service station canopy structure, said sign assembly comprising:

an elongated housing member adapted to be attached to said canopy structure, said housing member having upper and lower elongated sides, a pair of shorter end members, and an open front portion;

an elongated translucent panel member stretched over and covering said open front portion;

a plurality of point light sources positioned in said housing and providing illumination for said translucent panel member;

at least one light dispersion member suspended in said housing between said point light sources and said translucent panel member, said light dispersion member being substantially planar and having a plurality of light passages adjacent each of said point light sources in order to distribute light from said point light sources substantially uniformly over said translucent panel member; and at least one access means in said lower elongated side of said housing for allowing replacement of said point light sources from below and outside said housing.

47. The internally illuminated sign assembly of claim 46 wherein said point light sources each comprise metal halide lights.

48. The internally illuminated sign assembly of claim 46 wherein a separate light dispersion member is provided for each of said point light sources.

49. The internally illuminated sign assembly of claim 46 wherein said access means comprises a plurality of panel members.

50. The internally illuminated sign assembly of claim 49 wherein a separate panel member is provided for each of said point light sources.

51. The internally illuminated sign assembly of claim 49 wherein each of said panel members are spring-biased and hingedly attached to said housing.

52. The internally illuminated sign assembly of claim 46 wherein said light dispersion member is suspended from said upper and lower elongated sides of said housing.

53. The internally illuminated sign assembly of claim 46 further comprising a plurality of support brackets attached to said housing, and wherein said light dispersion member is suspended from said support brackets.

54. The internally illuminated sign assembly of claim 46 wherein said sign assembly is adopted to be attached to at least one fascia member of said canopy structure.

55. The internally illuminated sign assembly of claim 54 wherein said service station canopy structure has a plurality of fascia members and wherein two of said sign assemblies are adapted to be attached to two of said fascia members.

* * * * *